US006775858B1

(12) United States Patent
Miller

(10) Patent No.: US 6,775,858 B1
(45) Date of Patent: Aug. 17, 2004

(54) ELEVATING TOILET SEAT WITH LID OPENING MECHANISM

(76) Inventor: Stuart Earl Crispin Miller, 485 Manchester Street, Christchurch (NZ)

( * ) Notice: Subject to any disclaimer, the term of this patent is extended or adjusted under 35 U.S.C. 154(b) by 0 days.

(21) Appl. No.: 10/070,602

(22) PCT Filed: Aug. 30, 2000

(86) PCT No.: PCT/NZ00/00170

§ 371 (c)(1),
(2), (4) Date: Sep. 13, 2002

(87) PCT Pub. No.: WO01/15588

PCT Pub. Date: Mar. 8, 2001

(30) Foreign Application Priority Data

Aug. 30, 1999 (NZ) ..... 337475

(51) Int. Cl.[7] ..... A47K 13/10

(52) U.S. Cl. ..... 4/264.1; 4/254; 4/667; 4/246.3; 4/480; 4/241; 4/246.5; 4/237; 280/304.1; 280/250.1; 297/327; 297/330; 297/DIG. 4; 297/DIG. 10

(58) Field of Search ..... 4/254, 667, 480, 4/241, 246.1–246.5, 237; 280/304.1, 250.1; 297/DIG. 4, DIG. 10, 327, 330

(56) References Cited

U.S. PATENT DOCUMENTS

| | | | | | |
|---|---|---|---|---|---|
| 3,417,411 | A | * | 12/1968 | Greenwood | 4/246.3 |
| 4,133,062 | A | * | 1/1979 | Fulbright, Jr. | 4/246.1 |
| 4,168,552 | A | * | 9/1979 | Austin | 4/667 |
| 4,266,305 | A | * | 5/1981 | Kavaloski et al. | 4/480 |
| 4,510,631 | A | * | 4/1985 | Grady | 4/478 |
| 4,631,759 | A | | 12/1986 | Strasser | |
| 4,884,841 | A | * | 12/1989 | Holley | 297/331 |
| 5,027,446 | A | * | 7/1991 | Robertson | 4/254 |
| 5,031,251 | A | | 7/1991 | Williams et al. | |
| 5,063,617 | A | | 11/1991 | Ward et al. | |
| 5,095,555 | A | * | 3/1992 | Torii et al. | 4/237 |
| 5,309,583 | A | | 5/1994 | White et al. | |
| 5,444,877 | A | * | 8/1995 | Kumarasurier | 4/246.1 |
| 5,526,537 | A | * | 6/1996 | Conrad | 4/483 |
| 5,561,872 | A | * | 10/1996 | Phillips | 4/667 |
| 5,568,933 | A | * | 10/1996 | Mizuno | 280/42 |
| 5,592,703 | A | | 1/1997 | Jones et al. | |
| 6,189,160 | B1 | * | 2/2001 | Pettus | 4/246.1 |

FOREIGN PATENT DOCUMENTS

| | | |
|---|---|---|
| DE | 42 15 448 A1 | 11/1992 |
| JP | 2000-057468/05 | 11/1999 |

OTHER PUBLICATIONS

Patent Abstract of Japanese Publication No. 09084722 A, Published Mar. 31, 1997.
Patent Abstract of Japanese Publication No. 98–535257/46, Published Sep. 8, 1998.
Patent Abstract of Japanese Publication No. 2000–017222/02, Published Oct. 26, 1999.
Patent Abstract of Japanese Publication No. 2000–197668 A, Published Jul. 18, 2000.

* cited by examiner

*Primary Examiner*—Henry Bennett
*Assistant Examiner*—Azy Kokabi
(74) *Attorney, Agent, or Firm*—Knobb, Martens, Olson & Bear, LLP

(57) ABSTRACT

A height adjustable toilet seat apparatus for disabled users includes a toilet seat having a hinged lid. The apparatus may be fixed to a toilet bowl or to a wheelchair and includes telescopic legs for supporting the toilet seat and lid at different heights. A lid opening mechanism is operated by a foot lever slidably connected to at least one of said legs. A catch is biased to a holding position for holding the lid in a rotated attitude and a foot peddle and handle are provided to release the catch.

18 Claims, 22 Drawing Sheets

ELEVATING TOILET SEAT WITH LID OPENING MECHANISM

RELATED APPLICATIONS

This application claims the benefit of the New Zealand application No. 337475 filed Aug. 30, 1999 and the international application PCT/NZ00/00170 filed Aug. 30, 2000.

TECHNICAL FIELD

The present invention relates to a height-adjustable toilet seat for use by the elderly, the disabled or the handicapped as well as the able bodied. The present invention further relates to chairs and wheeled chairs incorporating a height-adjustable toilet seat.

BACKGROUND ART

Toilet seats are typically formed to a fixed height. Such a height is suitable for the physically able, but is not always suitable for those with limited mobility. Toilet fixtures of an enlarged or elongated bowl are known. However, such higher seats are generally of a less convenient height for mobile persons, or for children in the same household.

Toilet seats in which the base is higher than normal, or in some way elevated, are also known. However, these are normally of a fixed height. Thus, they are again inconvenient for able bodied users.

Removable inserts for seats are also known. In such instances the insert sits on or over the toilet bowl, generally placed in position by insertion into the bowl itself. This has the disadvantages of, firstly, being in the way of the flushing action of the toilet. Secondly, the arrangement does not allow for easy self cleaning of the insert (as is the case with the toilet bowl when it is flushed). Thirdly, whilst the insert can be easily removed, there is no sanitary place for it to be kept, where it is handy for further use, adjacent the toilet.

Toilets with adjustable heights or side rails are known. An example can be seen in U.S. Pat. No. 4,631,759, with the use of side rails and an adjustable grip. U.S. Pat. No. 5,031,251 discloses a mechanism connected to the bowl for raising and lowering the rim portion. However the plumbing either needs to be extended for these arrangements or standard toilet seats are required to be modified.

A further disadvantage of some types of arrangements is that they are not easily operated by the disabled or handicapped person wishing to use the toilet.

A still further disadvantage of the above types of seats or toilets with seats is that the upper, elevated position is not adjustable, from user to user.

Commodes of various designs are known. These can include a mobile commode incorporated into a wheeled chair. However, commodes require an in-built toilet seat, and cannot be used in conjunction with a normal toilet.

It is an object of the present invention to provide an adjustable toilet seat the height of which may be varied from the normal height to one of a plurality of elevated positions. It is a further object of the present invention to provide a height adjustable toilet seat which can be incorporated into a wheeled chair.

It is a further object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided an apparatus for raising and lowering a toilet seat assembly with respect to a toilet bowl, the toilet seat assembly having a hinged lid, the apparatus comprising:

clamping means for releasably securing the apparatus to the toilet bowl;

telescoping legs connected between the clamping means and the seat assembly for allowing the toilet seat assembly to be raised and lowered;

means for fixing the legs to support the toilet seat assembly at two or more heights above the toilet bowl; and a toilet seat lid opening mechanism having a foot lever pivotably connected to the lid for opening thereof, a catch biased to a holding position for holding the lid in one of a plurality of rotated attitudes and a foot peddle to release the catch.

Preferably the means for fixing the legs comprises detent means. The apparatus may further include means operable to simultaneously engage and disengage each detent. Alternatively, the legs may be fluid actuated.

With these features present it can be seen that the seat can be adjusted with the operation of one lever, making the adjustment of the height easy for a disabled or handicapped user, or an injured person. At the same time the toilet can be used in a normal manner by adjustment of the seat to its lowered position. Thus no special toilet needs to be installed for a person who is injured, disabled or handicapped.

According to another aspect of the present invention there is provided a height adjustable toilet seat apparatus as described above, wherein said height adjustable toilet seat further includes elements selected from:

(a) at least one arm rests;

(b) a back rest;

(c) a protective skirt arranged about the telescoping legs;

(d) a lever arm for remotely opening and closing a toilet seat cover;

(e) means for heating the toilet seat (f) a collapsible back rest;

(g) a protective skirt arranged about the telescoping legs; and (h) a protective skirt arranged about the telescoping legs, the skirt being injection molded from plastic.

Preferably, the arm rests and/or back rests may be hinged to be hingeable and collapsible when not in use. Optionally also, one or both arm rests may be hinged to lie flat, and may include one or more rollers therein, for assisting a person moving horizontally onto the arm and onto the apparatus.

Preferably, said lever arm is operable by a hand and/or a foot control.

The arms and back rests can thus be moved quickly and simply out the way, if an able-bodied person so wishes, when using the facilities.

According to another aspect of the present invention there is provided a wheeled chair, said chair including:

an apparatus for raising and lowering a seat assembly with respect to the wheeled chair, the apparatus being attached to the wheeled chair and the wheeled chair having a plurality of wheels arranged about and under the apparatus, the seat assembly having a hinged lid, the apparatus comprising:

telescoping legs connected between the wheeled chair and the seat assembly for allowing the toilet seat assembly to be raised and lowered;

means for fixing the legs to support the toilet seat at two or more heights above the wheeled chair, and a toilet seat lid opening mechanism having a foot lever pivotably connected to the lid for opening thereof, a catch biased to a holding position for holding the lid in one of a plurality rotated attitudes and a foot peddle to release the detent.

Thus, the height adjustment apparatus can be incorporated into a chair for use by a disabled or handicapped person. Thus a special commode, or commode chair is not needed in addition to the above chair. It can also be used a wheel chair, in the usual way.

BRIEF DESCRIPTION OF DRAWINGS

Further aspects of the present invention will become apparent from the following description which is given by way of example only, and with reference to the accompanying drawings in which.

BEST MODES FOR CARRYING OUT THE INVENTION

Figure 1:
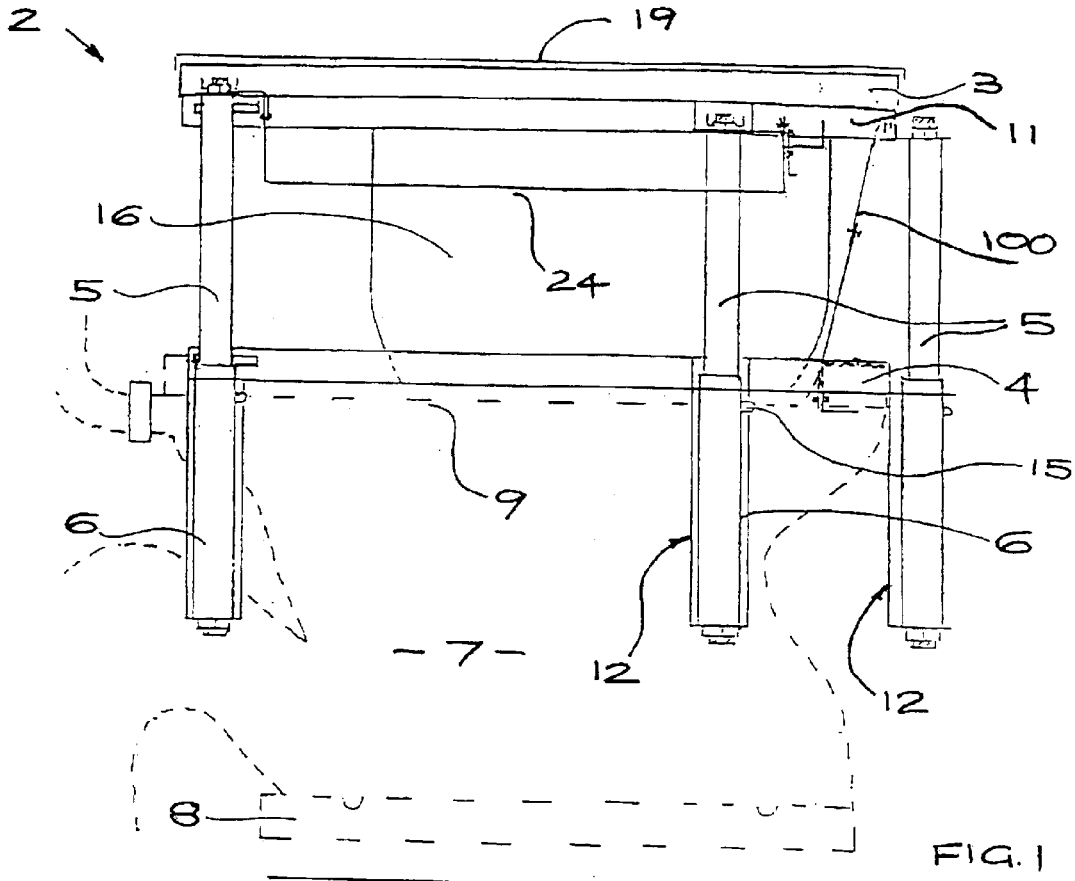
FIG. 1 is a side view of a first preferred embodiment of the seat apparatus of the present invention in an extended position, with a toilet in outline only.
Figure 2:
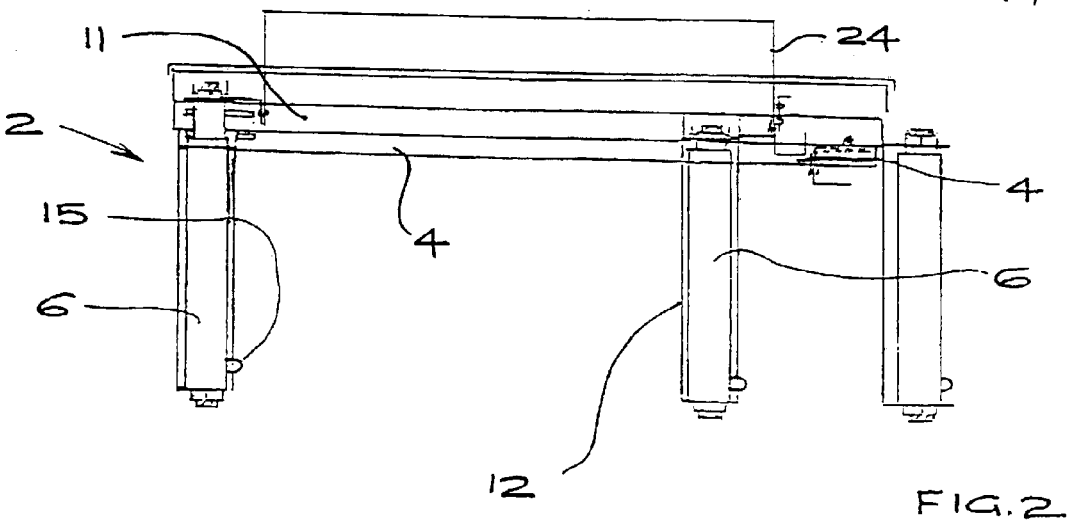
FIG. 2 is a side view of the first preferred embodiment of the seat apparatus of the present invention in a lowered position.

Referring to FIGS. 1 to 6, a toilet seat apparatus 2, which is capable of height adjustment to a plurality of positions, is thereshown. The apparatus 2 includes a hinged seat component 3 (of known type), a clamping band 4, five telescoping legs 5, each leg 5 being within a holder 6, and a seat frame 11 (as best shown in FIGS. 1 and 2).

The apparatus 2 is associated with a standard, fixed toilet bowl 7 (FIGS. 1, 3, and 5) which has a base 8 and in-turned, top edge 9. The plumbing and arrangement of the bowl 7, the base 8, and the top edge 9 are all of known type. The apparatus 2 further includes a hinged lid 19 securable to the frame 11 at the back thereof. The hinged securement is of the same type as is known for securement of a hinged seat cover to a known toilet seat.

The clamping band 4 is a metal band, of known type, which is clamped about the top edge 9 to secure the apparatus 2 to the bowl 7. The seat frame 11 is also a metal band of the same general shape and type as the clamping band 4. Preferably these two components, the clamping band 4 and the seat frame 11, sit together in complementary manner when the seat is in the lowered position (of FIGS. 2, 4 and 6). If so desired, an additional brace 22 (FIGS. 5 and 6) across the back of the toilet may be added to the clamping band 4. Such a brace, if used in conjunction with the clamping band 4, may be secured by use of the existing bolt holes (for securement of the lid to the bowl).

Figure 3:
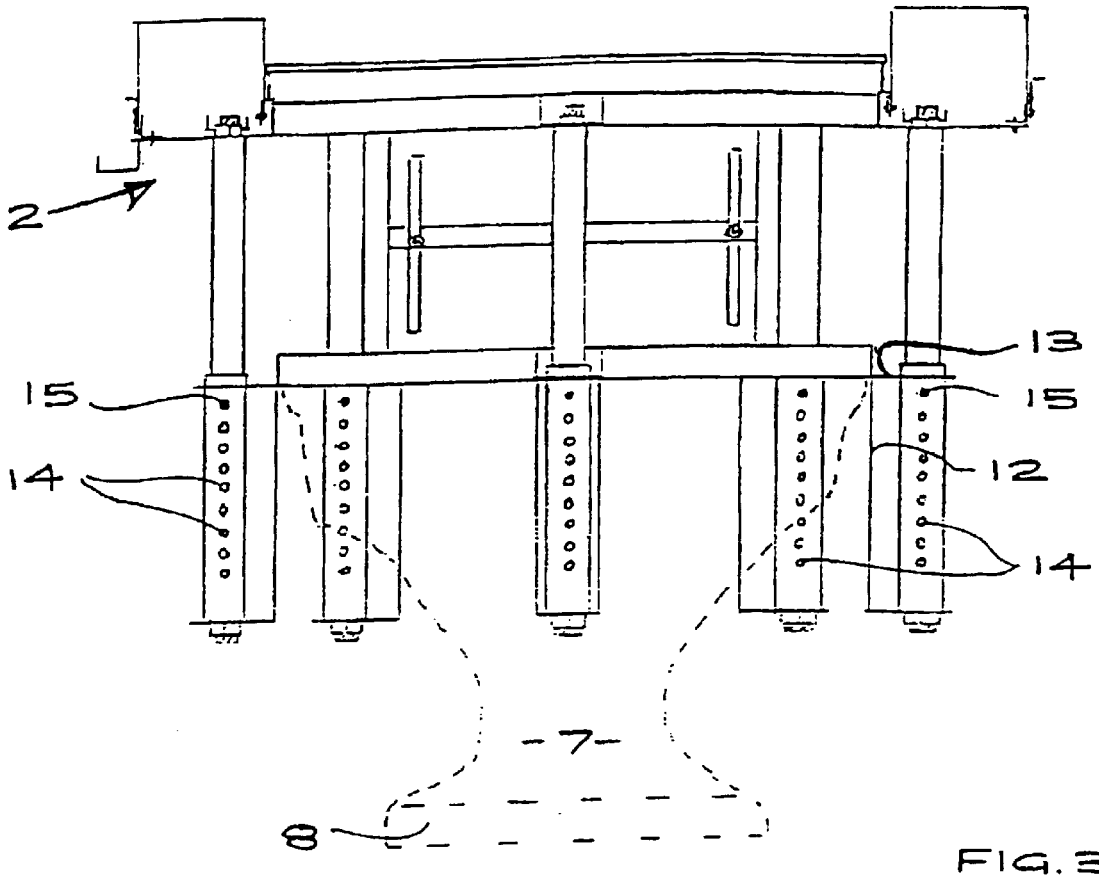
FIG. 3 is a front view of the first preferred embodiment of seat apparatus of the present invention in the same position as in FIG. 1.
Figure 5:
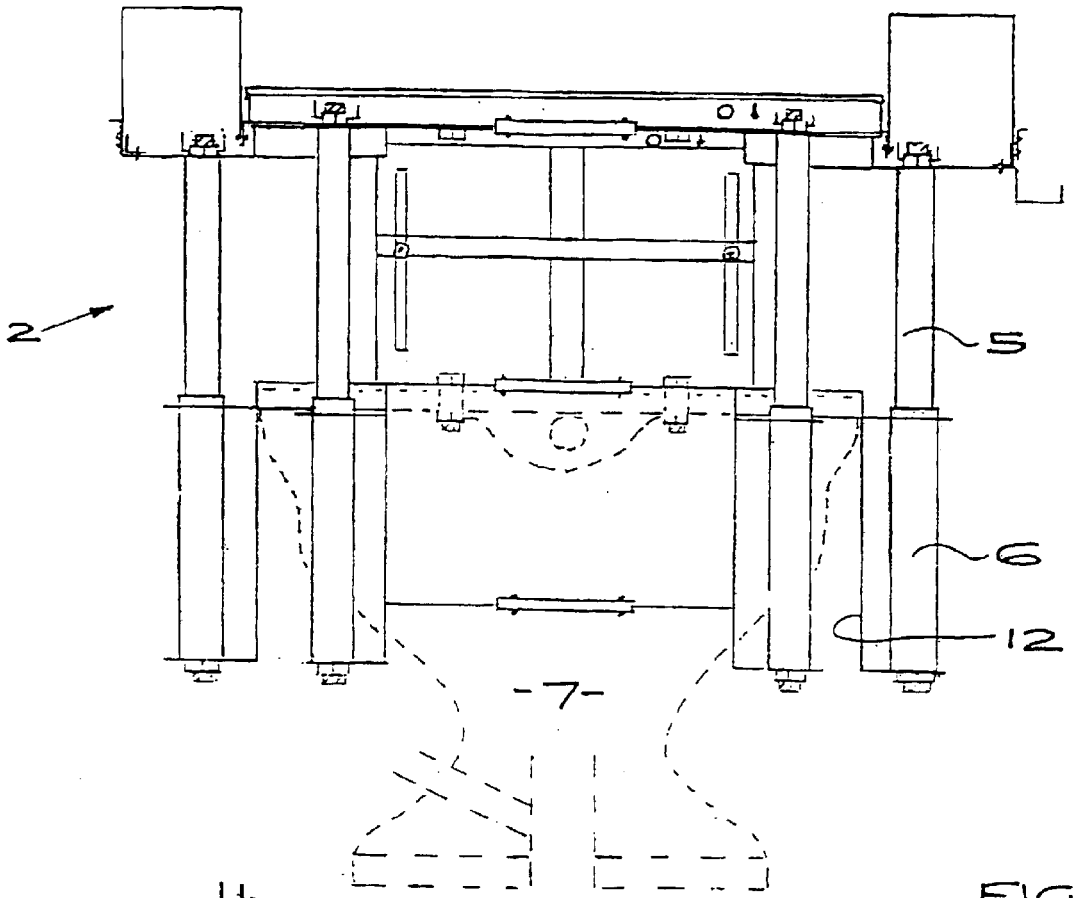
FIG. 5 is a back view of the first preferred embodiment of the seat apparatus of the present invention in the same position as in FIG. 1.

Referring to FIGS. 1, 3 and 5, each leg 5, which is capable of sliding within the respective holder 6, is secured at the top thereof to the seat frame 11. The respective holder 6 is secured to the clamping band 4 by a rigid flange 12. Optionally the flange 12 includes an additional shoulder 13 at the top to further locate the top of the respective holder 6.

Referring to FIGS. 1 to 4, each holder 6 incorporates a plurality of holes 14 evenly spaced along the height thereof. Each leg 5 includes a detent mechanism comprising a spring loaded pin 15 capable of locating in and through each hole 14 depending on the height of the leg 5 relative to the holes 14.

In the embodiment shown the apparatus includes five telescoping legs 5 (and corresponding holders 6): two spaced on opposing sides and one at the front of the bowl 7. However, it will be appreciated that there may be three legs 5, with one positioned at the front of the bowl 7, and two adjacent the rear of the bowl 7, one on each side thereof. Alternatively, there may be four legs 5, (and corresponding holders 6), with the front leg 5 omitted, as is desired.

It will be appreciated that after disengaging the pins 15, the legs 5 may be moved from position to position with ease, thereafter locating and locking in another hole to fix the height of the apparatus 2, until adjustment is again required. While shown as pins 15, the detent means may include other known detent mechanisms such as spring loaded ball bearings, if so desired.

Thus a disabled person may be able to adjust the height of the apparatus 2 with comparative ease, but also be assured that the apparatus 2 will remain at the chosen height until further adjustment to the legs 5 is made.

Figure 7A:
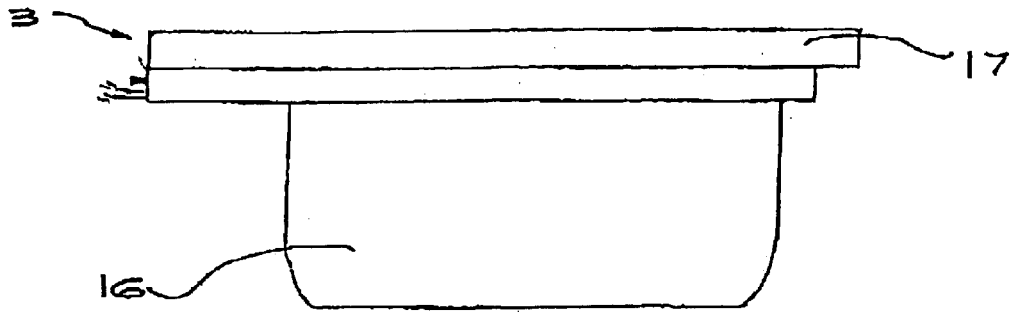
FIGS. 7*a* and 7*b* are side views of two alternative inserts for the toilet seat apparatus of the present invention.
Figure 7B:
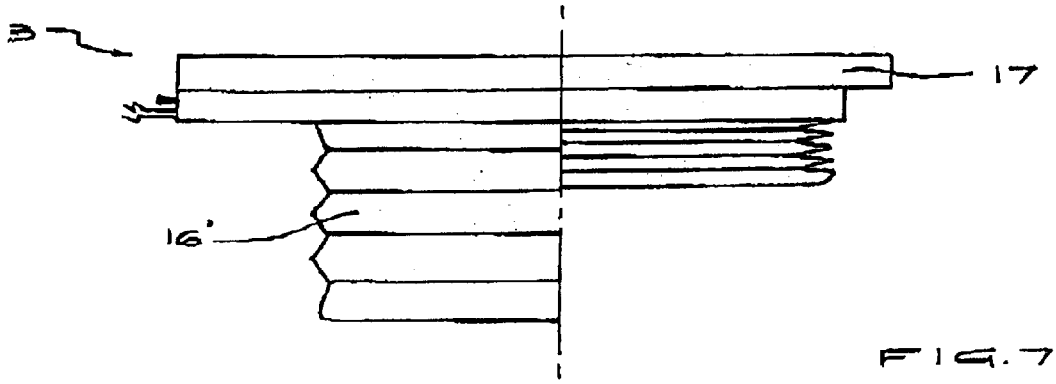

Referring to FIGS. 1, 7*a*, 7*b*, 8 and 9, a seat 3 having a removable insert 16 is thereshown. The seat 3 includes a top flange 17 which is capable of being supported by the seat frame 11, being raised and lowered therewith. The insert 16 is of a shape complementary to the internal shape of the top 9 of the bowl 7. Alternatively, the insert may be constructed from flexible material in order to conform to the inner shape of a range of different models of toilet bowl 7. FIG. 7*b* illustrates an alternative insert 16' having a bellows or concertina type construction, and shown in both extended and retracted positions. The concertina sides of the insert 16' providing a continuous connection between the bowl 7 and the seat 3 as the seat 3 is raised and lowered.

The top flange 17 of the seat 3 further includes a heating coil 21 of known type within the body of the flange 17 or on the underside thereof. The insertion and arrangement of the heating coil 21 can be fashioned in known manner. The coil 21 is connected electrically to a thermostat 20*a* and on/off controls 20 (FIGS. 8, 9), in known manner. The top 17 includes a cover 18 covering the coil 21, in order that the user does not come into contact with the exposed coil 21. Thus, with a known 100 watt heating coil 21, extra low voltage and a known transformer (not shown), the heating coil 21 may be left on thermostatic control. The voltage range is 12 to 24 volts.

Figure 4:
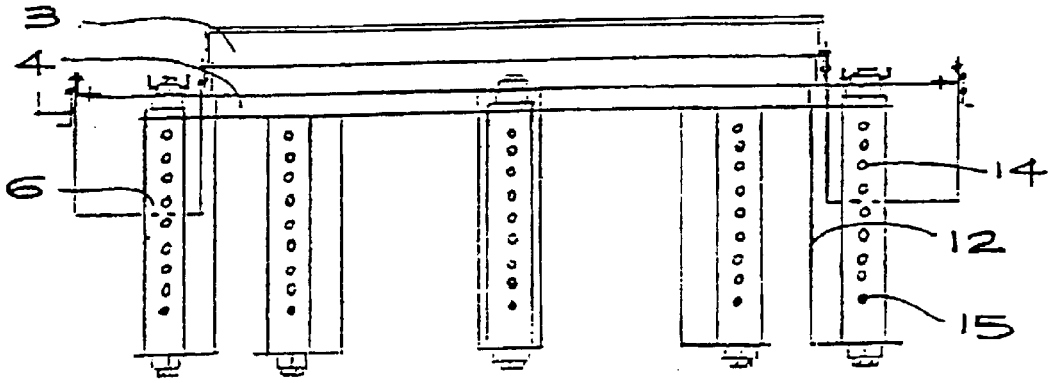
FIG. 4 is a front view of the first preferred embodiment of the seat apparatus of the present invention in the same position as in FIG. 2.
Figure 6:
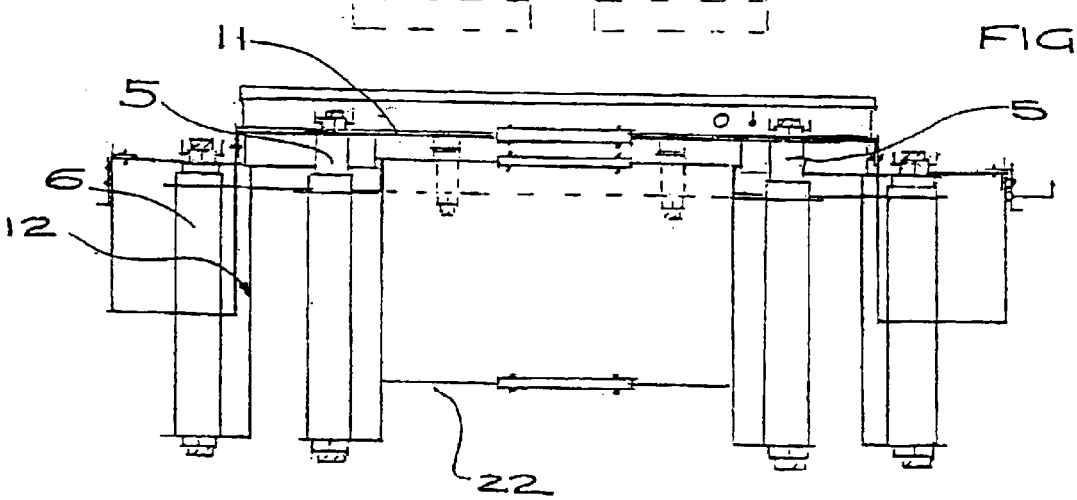
FIG. 6 is a back view of the first preferred embodiment of the seat apparatus of the present invention in the same position as in FIG. 2.

The above described apparatus 2 operates as follows:

The apparatus 2 starts in the lower position (FIGS. 2, 4 and 6). In this position any insert 16 is either removed or nested within the bowl 7, depending on the shape and size of the insert 16. The lid 19 is closed in the normal manner. The legs 5 each fully encased within the respective holder 6, with the pin 15 in the lowermost hole 14 (FIG. 4).

Alternatively, the insert 16 may further include a liner (not shown) of the same general shape as the straight sided insert 16. The liner 160 may be removable for washing (etc).

The apparatus 2 is raised to an elevated position by pressing in the pins 15 and pulling the frame 11 and the apparatus 2 in an upward direction. The release of the pins 15 is automatic and allows the legs 5 to slide in an upward direction until the pins 15 engage with a hole 14 in a higher position on each respective holder 6. Once all the pins 15 are engaged, the apparatus 2 is retained in an elevated position. Depending on the height selected, the insert 16 either sits on top of or within the bowl 7. The insert 16 can thus be easily removed for cleaning.

As the lid 19 is hinged to the frame 11, the lid 19 also moves up with the apparatus 2. The lid can be opened in standard manner, and the insert 16 placed so that the top flange 17 rests on the seat frame 11.

It will be appreciated by those skilled in the art, that with a plurality of holes 14, the height to which the apparatus 2 is raised can be selected to suit the user. It will also be appreciated by those skilled in the art that only two or three sets of holes 14 may be needed.

Also, it will be appreciated that the shape of the insert 16 may be adapted so that the insert 16 can remain permanently a part of the apparatus 2, if so desired.

The insert 16 may be of any appropriate material that is easy to keep clean, and with an aesthetically pleasing surface finish. For example the material of the insert 16 may be selected from plastics materials, fibreglass, metal, and wood, or any combination thereof.

It will further be appreciated that the clamping band 4 can be secured releasably about the bowl 7. Thus, should the height adjustment no longer be needed the apparatus 2 can be removed. A seat and lid of standard type can be re-secured to the bolt holes on the standard toilet bowl 7, in known manner, once the apparatus 2 of the present invention is no longer needed on a longer term basis.

Whilst the above described apparatus 2 has been described with reference to the addition of an insert 16, it will be appreciated that this may be omitted, if so desired. Similarly, if so desired, the heater coil 21 and associated thermostat 20*a* may be omitted.

Also, it will be appreciated that whilst the invention is described with reference to a fixed, standard type of toilet, the apparatus 2 may be adapted to fit a commode or other type of portable toilet with a bowl, as described below.

Figure 10:
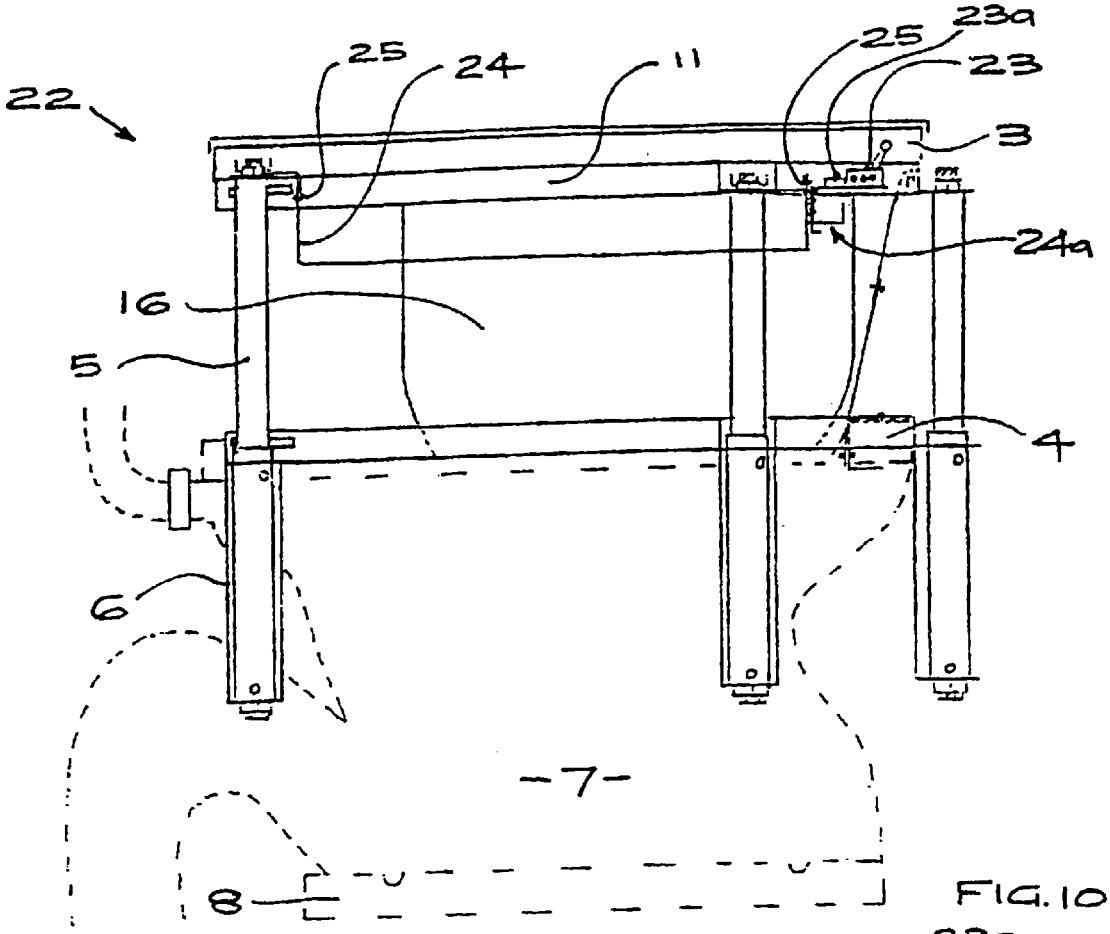
FIG. 10 is a side view of a first preferred embodiment of the seat apparatus of the present invention in the extended position, showing actuator controls.
Figure 11:
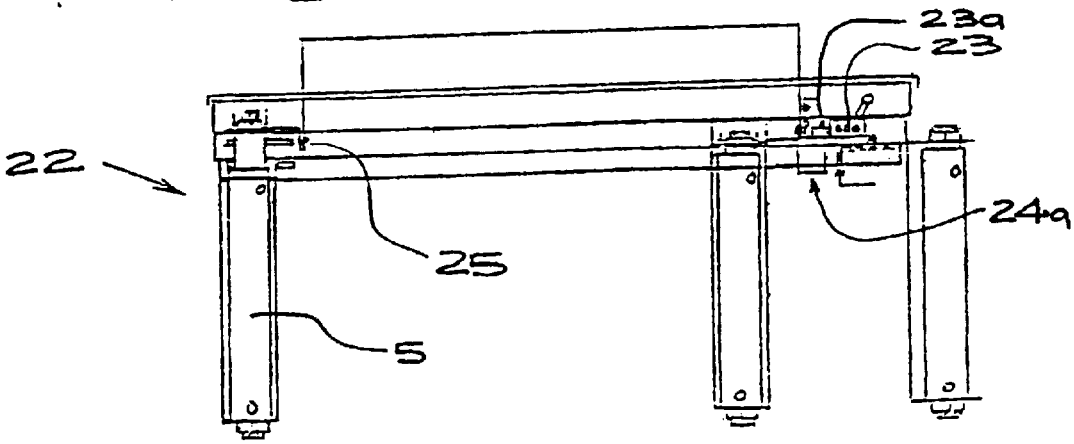
FIG. 11 is a side view of the first preferred embodiment of the seat apparatus of the present invention in the lowered position, showing actuator controls.

Referring to FIGS. 10 and 11, a variation of the first embodiment of the apparatus 2 is thereshown. Like numbered parts refer to the same part as for the first preferred embodiment. In this variation the apparatus 2 is actuated using fluid power. Preferably linear actuators are employed, alternatively other types, such a cushion type actuators may be used. The legs 5 incorporate double-acting rams, the actuation of which is controlled via a manual lever 23, of known type. Optionally, the double acting rams may be replaced by singe acting rams.

In FIG. 10 a side arm 24 is shown in the down position. In FIG. 11 the side arm 24 is shown in the up position. The arm 24 is formed of a "U" channel of steel. However, it will be appreciated that any type of material suitable for an armrest, with or without padding, may be used.

The armrest 24 is hinged at both ends about pivot point 25, in known manner. It will be appreciated that with known types of arrangement, a three-position arm rest 24 may also be incorporated without departing from the scope of the invention. Also illustrated is a toilet roll holder 24*a* fitted to the arm mounting.

Figure 12:
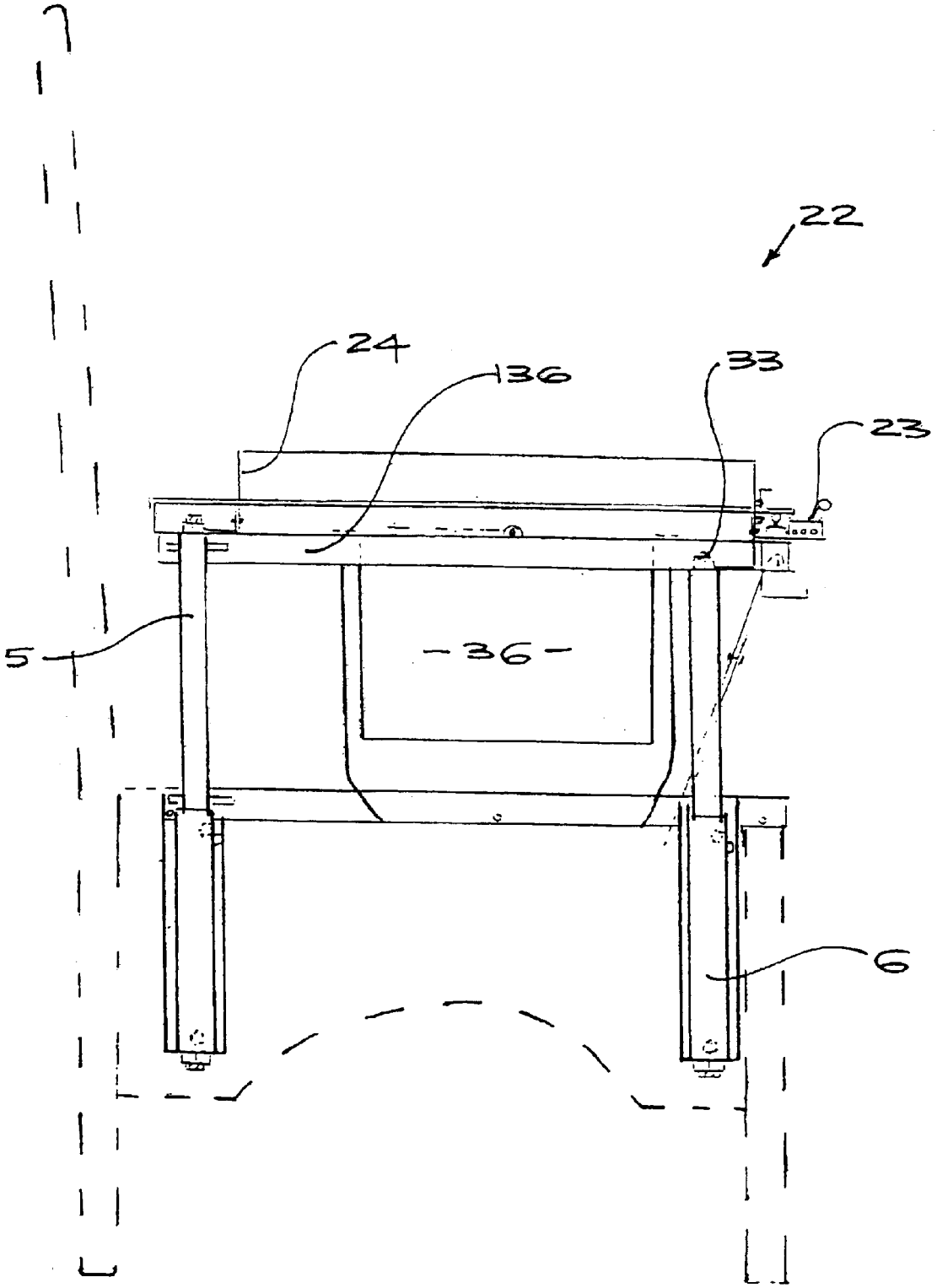
FIG. 12 is a side view of a second preferred embodiment of the seat apparatus of the present invention.
Figure 13:
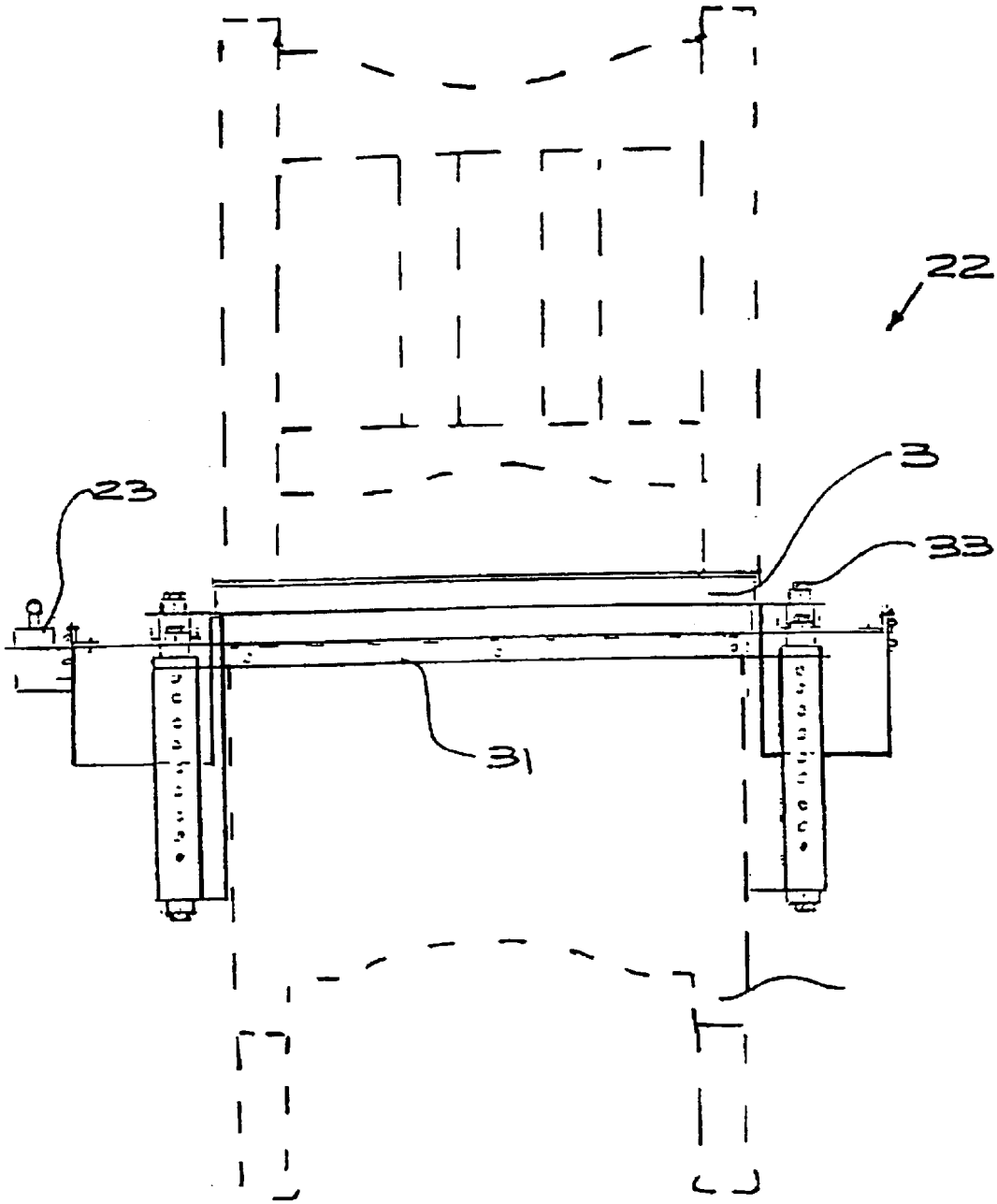
FIG. 13 is a front view of the second preferred embodiment of the seat apparatus of the present invention.
Figure 14:
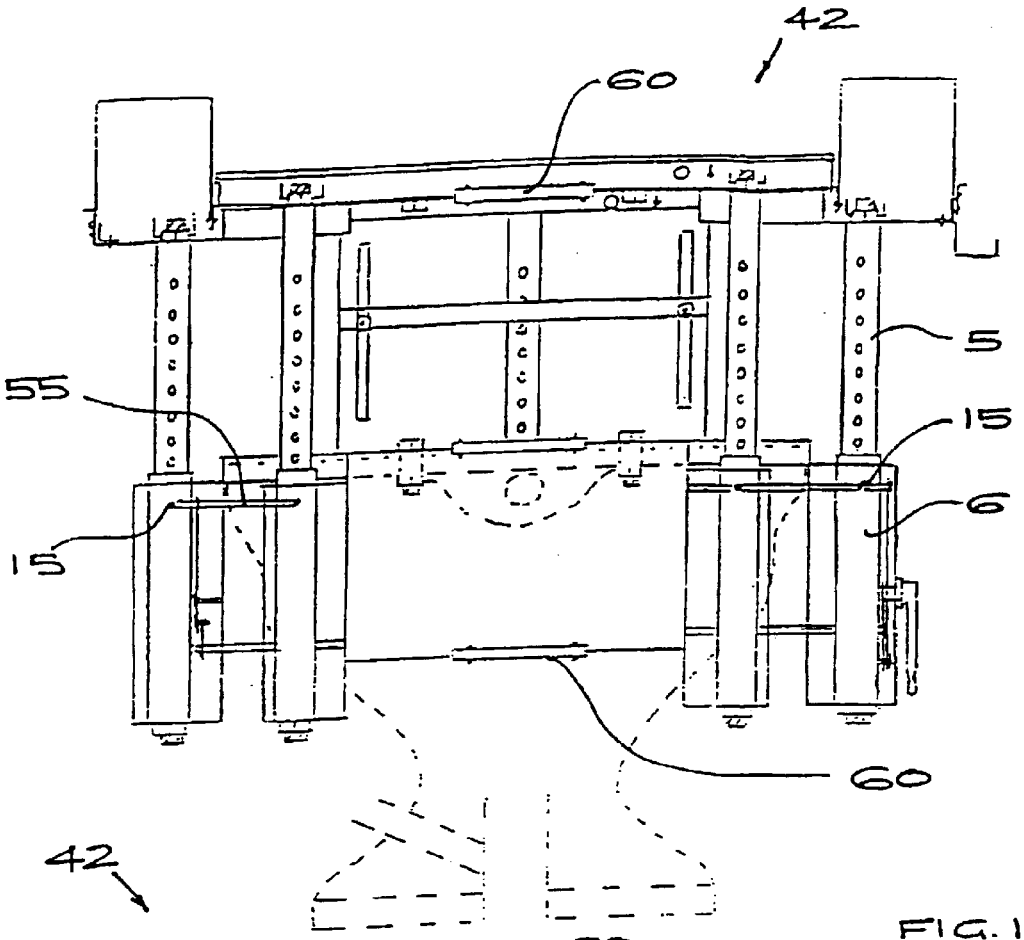
FIG. 14 is a back view of a third preferred embodiment of the seat apparatus of the present invention, in an extended position.
Figure 15:
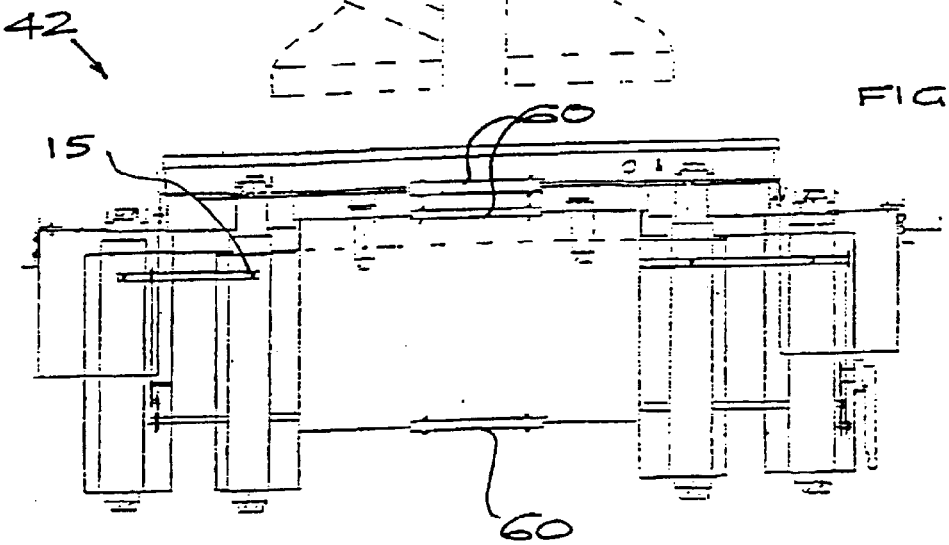
FIG. 15 is a back view of a third preferred embodiment of the seat apparatus of the present invention, in a lowered position.
Figure 16:
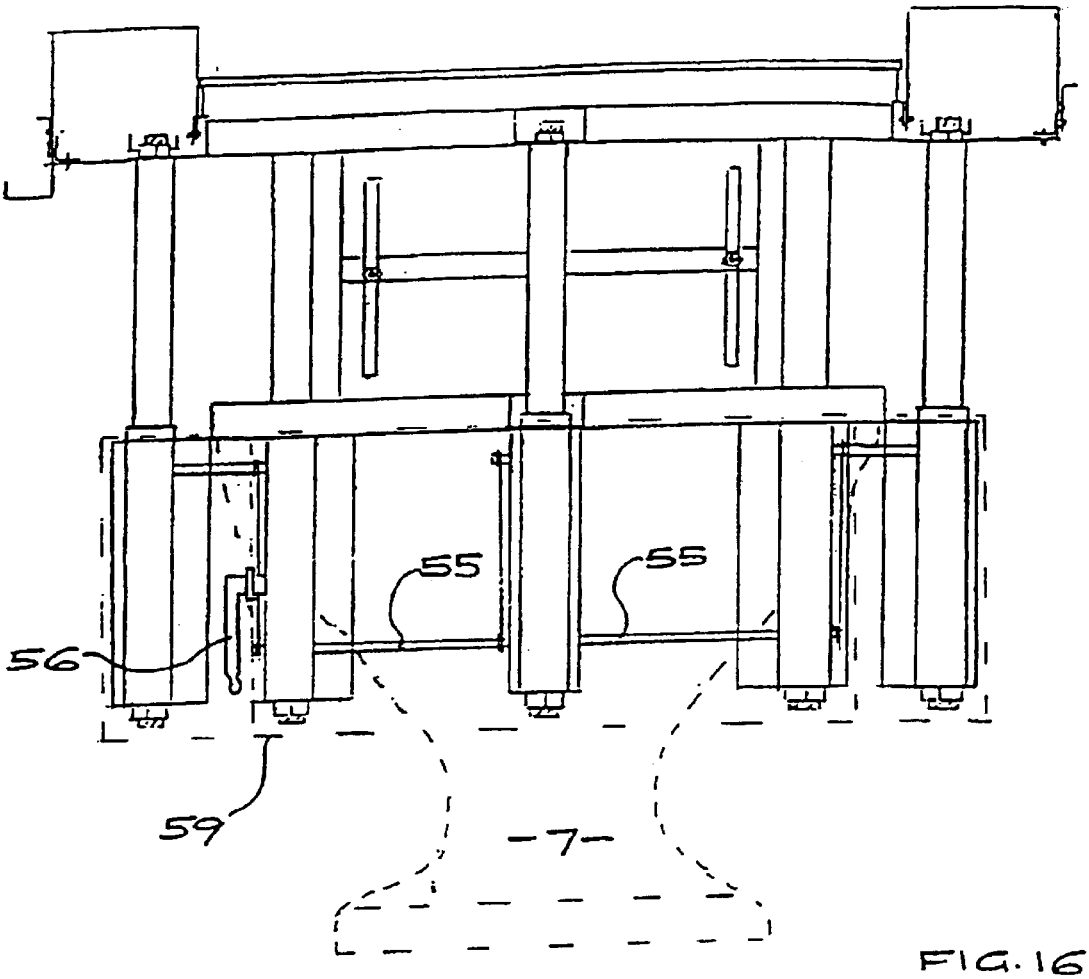
FIG. 16 is a front view of a third preferred embodiment of the seat apparatus of the present invention, in an extended position.
Figure 17:
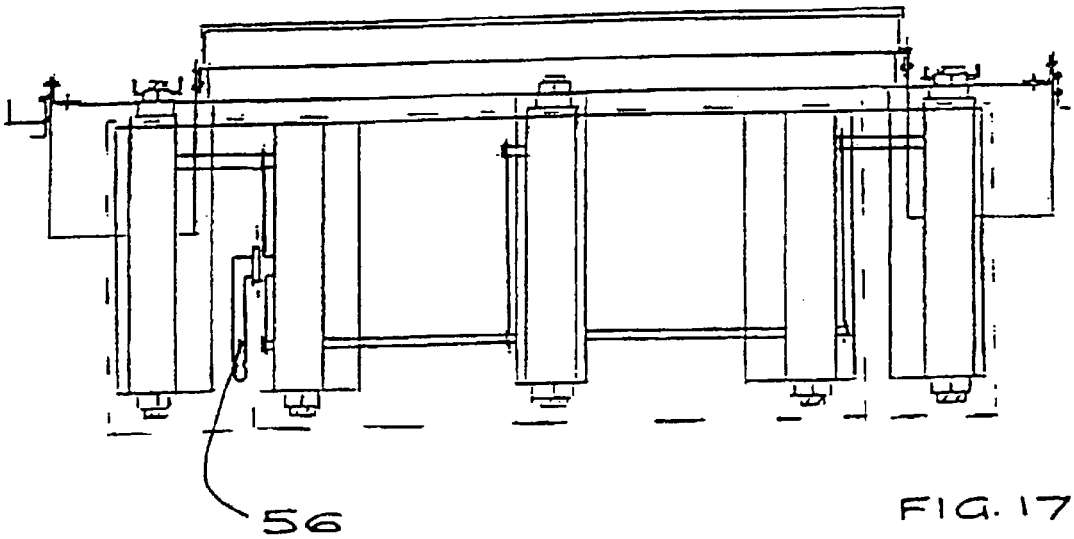
FIG. 17 is a front view of a third preferred embodiment of the seat apparatus of the present invention, in a lowered position.
Figure 18:
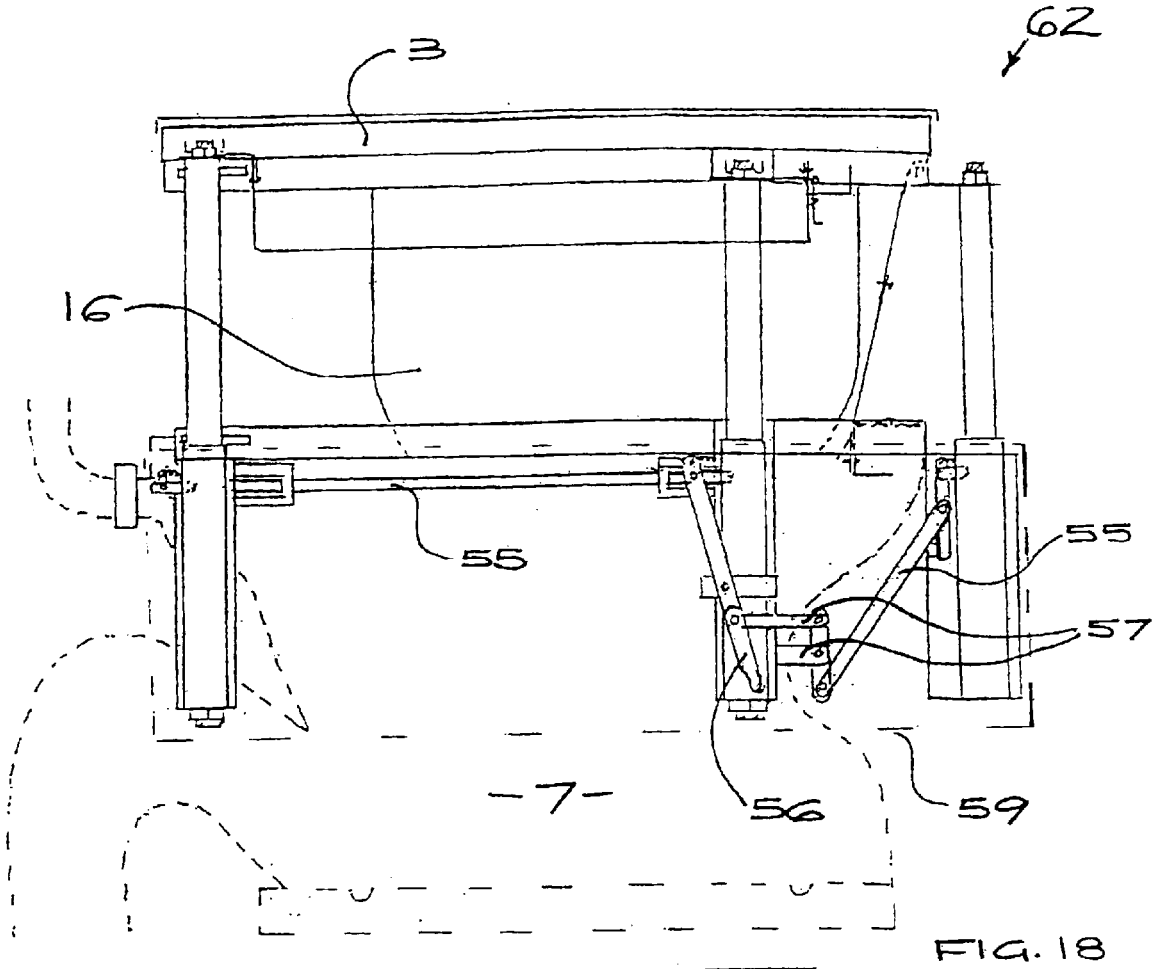
FIG. 18 is a side view of a third preferred embodiment of the seat apparatus of the present invention, in an extended position.
Figure 19:
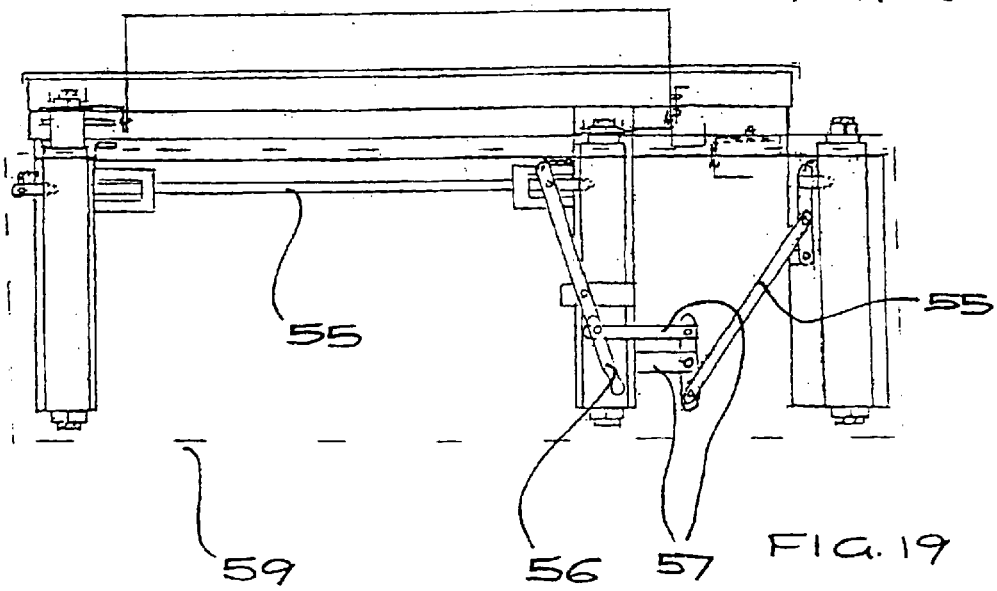
FIG. 19 is a side view of a third preferred embodiment of the seat apparatus of the present invention, in a lowered position.

Referring to FIGS. 12 and 13, the second preferred embodiment of the seat apparatus 22 of the present is thereshown. Like numbered parts refer to the same part as in the first preferred embodiment. The apparatus 22 incorporates a standard commode chair 32 (shown in dotted outline) of known type. The chair commode 32 has front, back, sides and legs, in the ordinary manner.

In this embodiment the insert 36 has a base as well as sides. The telescoping arrangement of the legs and holder (5, 6) works in the same manner as for the second preferred embodiment, except that there are four legs and holders (5, 6) not five of each. Arms 24, operating in the same manner of the first preferred embodiment, are present. These are shown in the drawings but may be optional. The heating element (not shown) and control 23 for controlling the fluid powered linear actuators is also present. In this embodiment the frame 31 incorporates a plurality of strips of metal 136, which engage with a nut and bolt of known type 33 at the top of the telescoping arms and holders (5, 6).

Referring to FIGS. 14 to 19 these disclose a third preferred embodiment of the apparatus of the present invention 42. Like numbered parts refer to the same part as for the first preferred embodiment.

In this third embodiment the detent means are connected mechanically in order that they can be operated by a single action. Pins 15 within each set of telescoping legs and holders (5, 6) are rigidly connected together by a series of bars 55 (or rigid connecting links). By the operation of the lever handle 56 (FIGS. 18 and 19) the pins 15 can be pushed mechanically, so that all pins 15 are pushed at the same time. This considerably assists with the raising and lowering of the insert 16 and the seat 3. This is especially so with fingers which are not agile. Mechanical linkages 55, 57 are arranged in known manner to operate from one side of the apparatus 42 to the second side.

In this embodiment of the apparatus 42 there is also shown a skirt 59 (in dotted outline). The skirt is provided to drape and hide the sets of telescoping legs and holders (5, 6) and to act as a protection to the person using the toilet from any hard corners or edges of the apparatus 42. The skirt 59 may be of any appropriate protective material for example; an injection moulded plastic shape of rigid form. Other known materials may be used, as is desired.

It will be appreciated that the hingeable arms 24 of the first preferred embodiment (FIGS. 11 and 12) may be used to assist this embodiment of the apparatus 42, if so desired.

Figure 8:
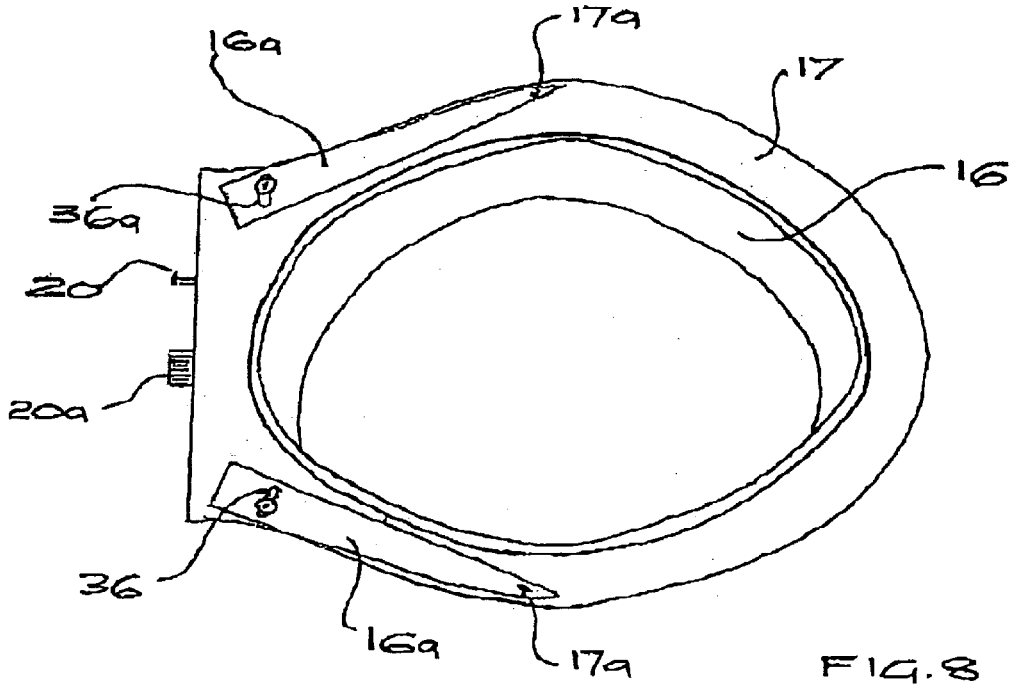
FIG. 8 is a perspective view from above of the insert of the first preferred embodiment of the seat apparatus of the present invention.
Figure 9:
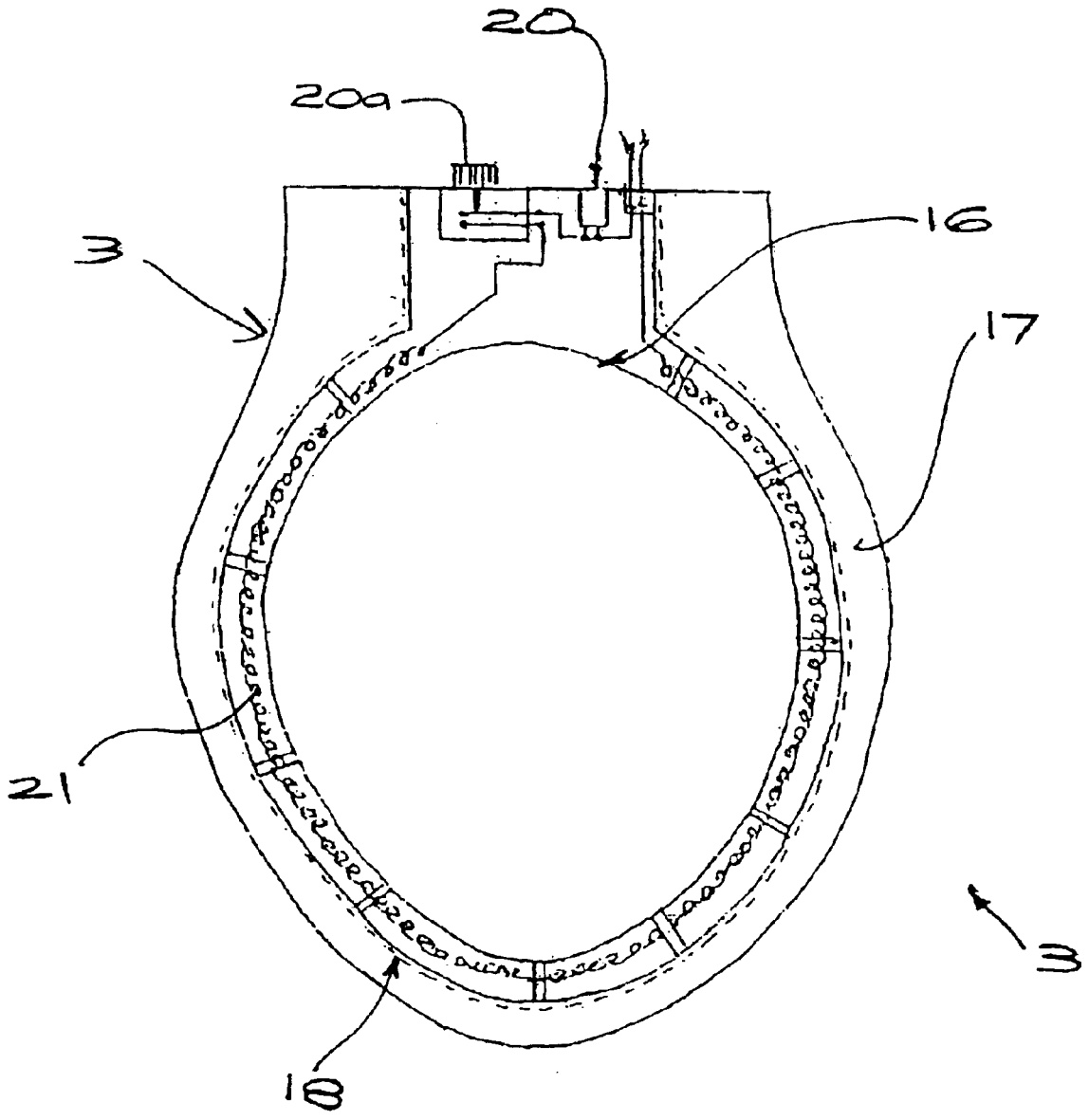
FIG. 9 is a plan view of the insert of the first preferred embodiment of the seat apparatus of the present invention, showing a heater.

This embodiment of the apparatus 42 also shows a lengthening strap 60 (FIGS. 14 and 15), which can be used to adjust the width of the back portion of the apparatus 42. It will be appreciated by those skilled in the art that the width of the back of all styles and designs of toilets is not constant. With the assistance of straps 60, the rear end of the apparatus 42 may be adjusted in width to accommodate such variations. Also to accommodate such variations the seat 17 of the insert 16 may include flanges 16*a* hingeable at 17*a* and movable within a limited range as provided by slots 36*a* (FIG. 8). In this manner the width of the insert 16 and apparatus 42 (or apparatus 2) may be varied to accommodate varying types and styles of toilet bowls 7.

Figure 20:
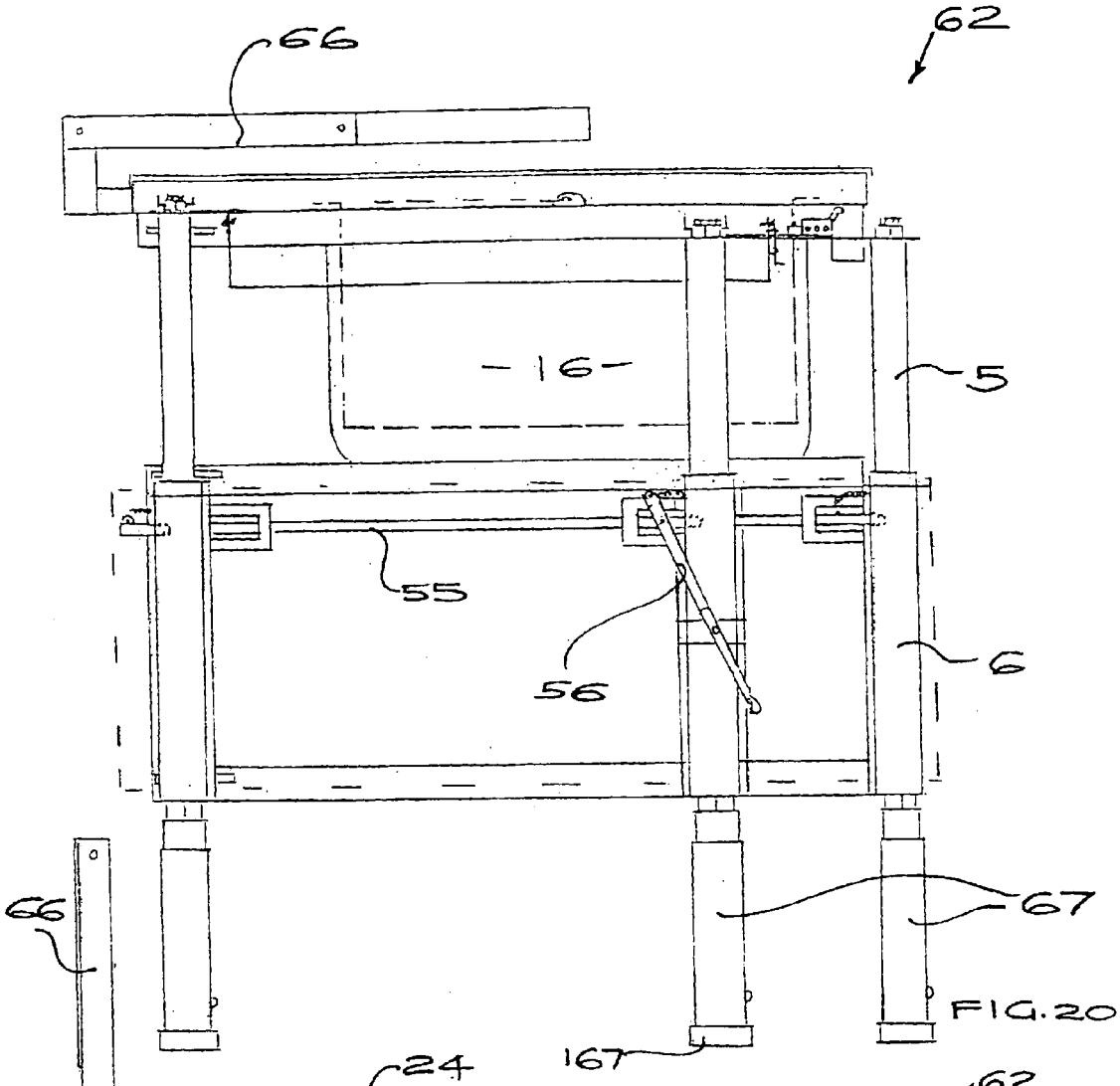
FIG. 20 is a side view of a fourth preferred embodiment of the seat apparatus of the present invention, in an extended position.
Figure 21:
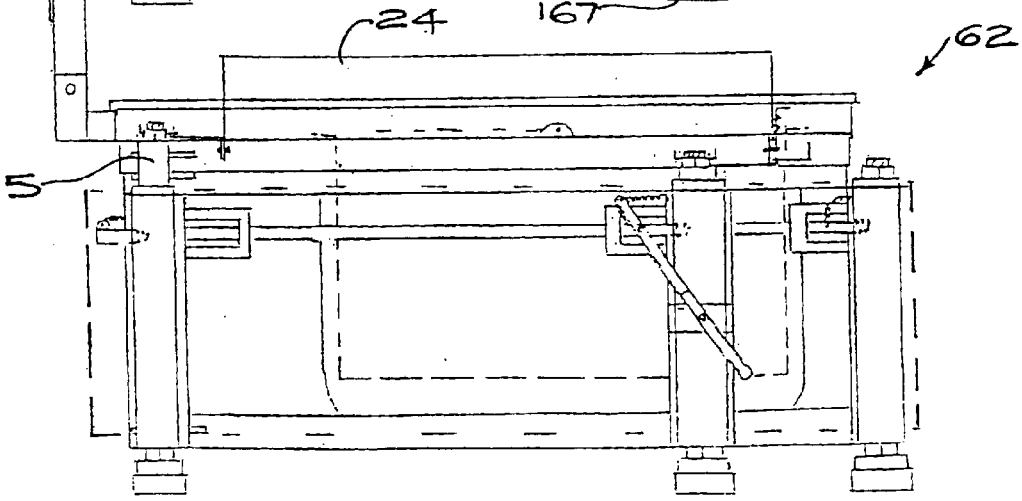
FIG. 21 is a side view of a fourth preferred embodiment of the seat apparatus of the present invention, in a lowered position.

Referring to FIGS. 20 and 21, a fourth preferred embodiment of the apparatus 62 is thereshown. Like numbered parts refer to the same part as for the first preferred embodiment. In this fourth preferred embodiment the apparatus 62 incorporates the lever arm 56 and arrangement of straps 55 for operation of the pins 15 in the legs and inserts (5, 6). The apparatus 62 includes an insert 36 of the second preferred embodiment. Also shown a hinged back 66, which can fold down flush with the seat cover 3.

The base of the legs and holders (5, 6) incorporate feet 67 having removable pads 167 adapted to enable the apparatus 62 to be rested on the ground or on a chair. The feet 67 are telescopically extendable and may also be readily removed if not required. It will be appreciated that the apparatus 62 is very compact and could also be positioned on a low table or other furniture when needed. It is also well adapted for use in a car, caravan or out-of-doors when camping etc.

Whilst the hingeable back 66 has been shown with reference to the fourth preferred embodiment 62, it will be appreciated that the hinged back 66 may also be used in other embodiments, as is desired. Preferably the back 66 is from a rigid metal strip, or other known materials appropriate for use for a backing support for a person. It may be padded or not, as is desired.

Figure 22:
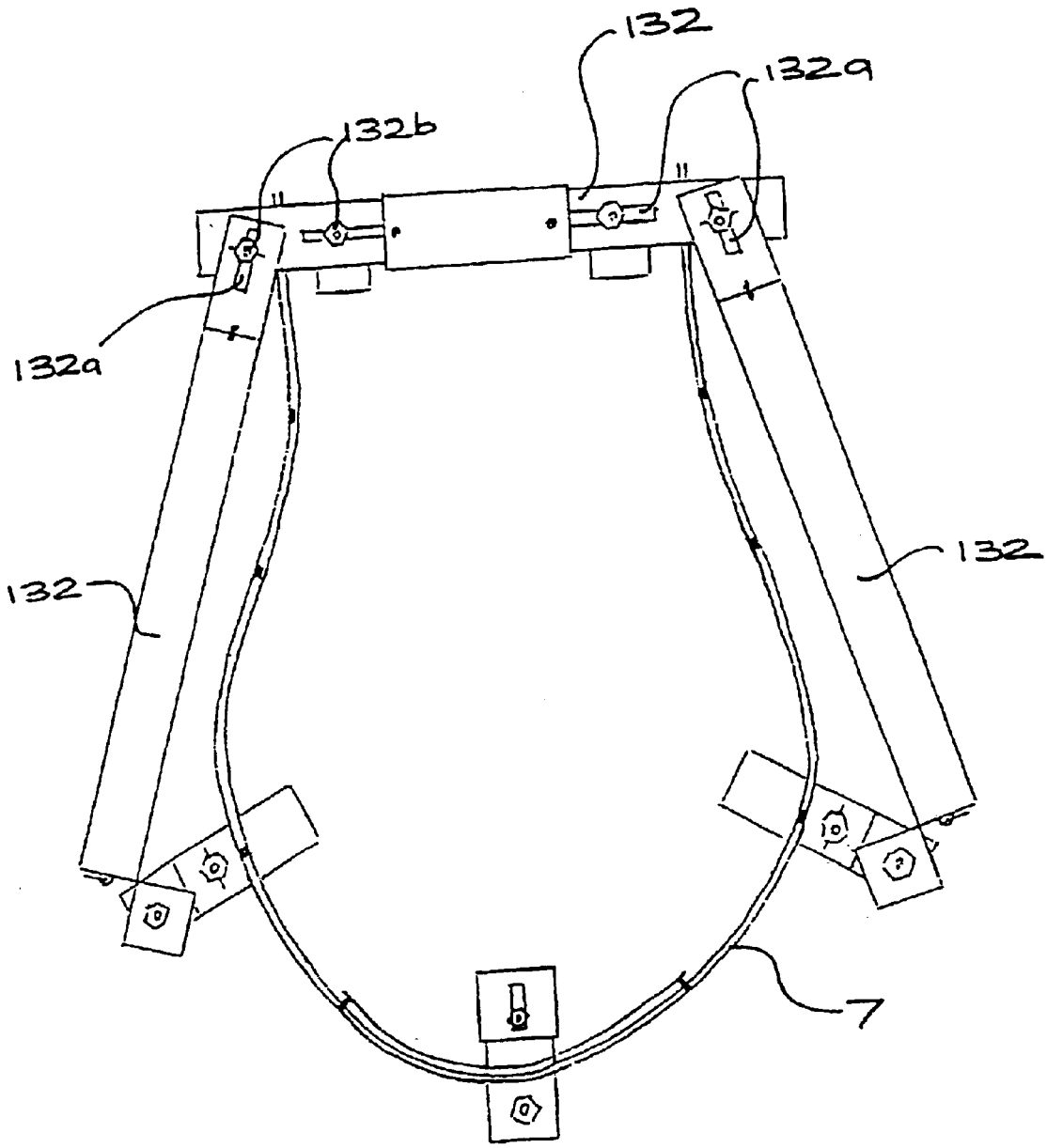
FIG. 22 is a plan view from above of the arrangement of part of the support frame of the seat apparatus of the present invention.

Referring to FIG. 22, the means of clamping the apparatus 2 to a bowl 7 includes slotted members 132 positioned about the periphery of the bowl. Adjustability to accommodate bowls 7 having varying dimensions is provided by way of slots 132*a* in the members 132 fixed together with nuts and bolts 132*b*, which can be tightened once the width of the apparatus 62 is adjusted.

Figure 23:
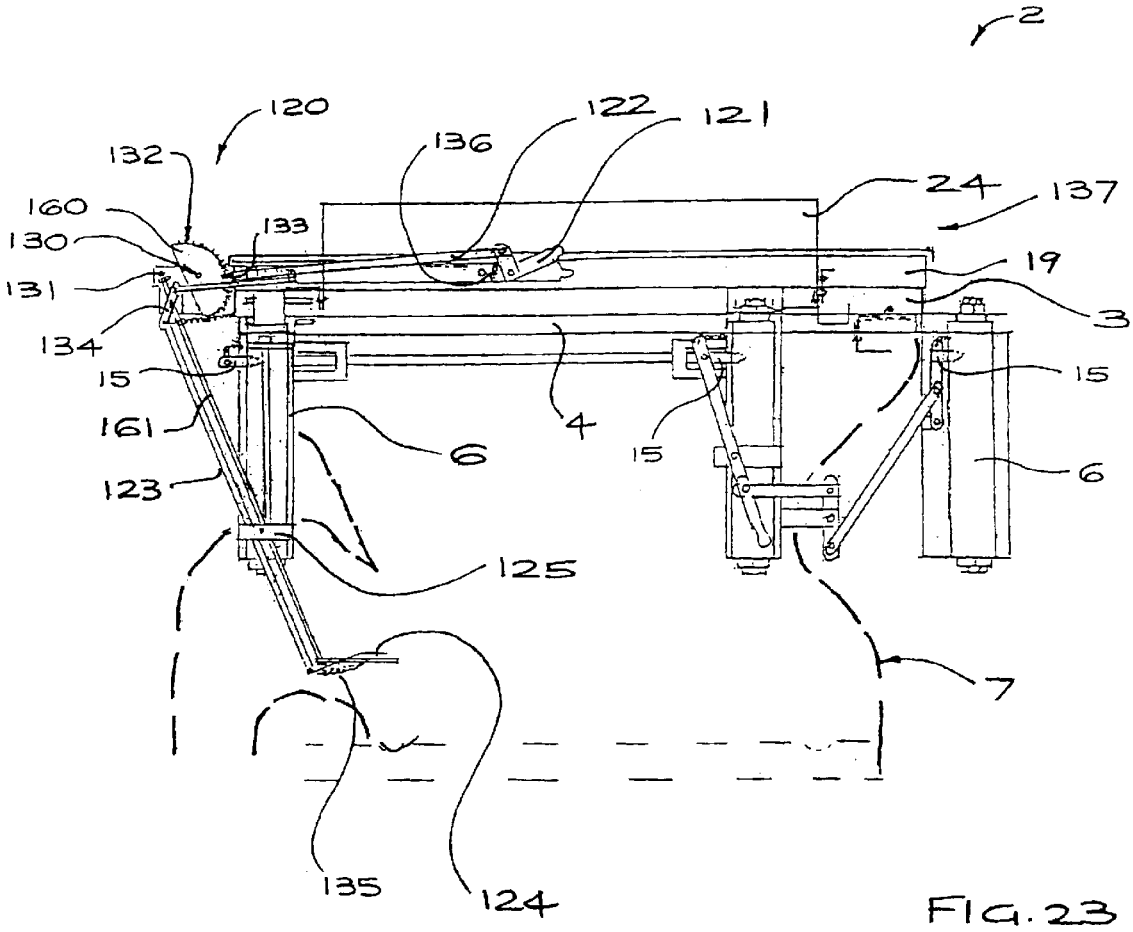
FIG. 23 is a side view of the seat cover lifting mechanism of the seat apparatus of the present invention, with the cover in the closed position.
Figure 24:
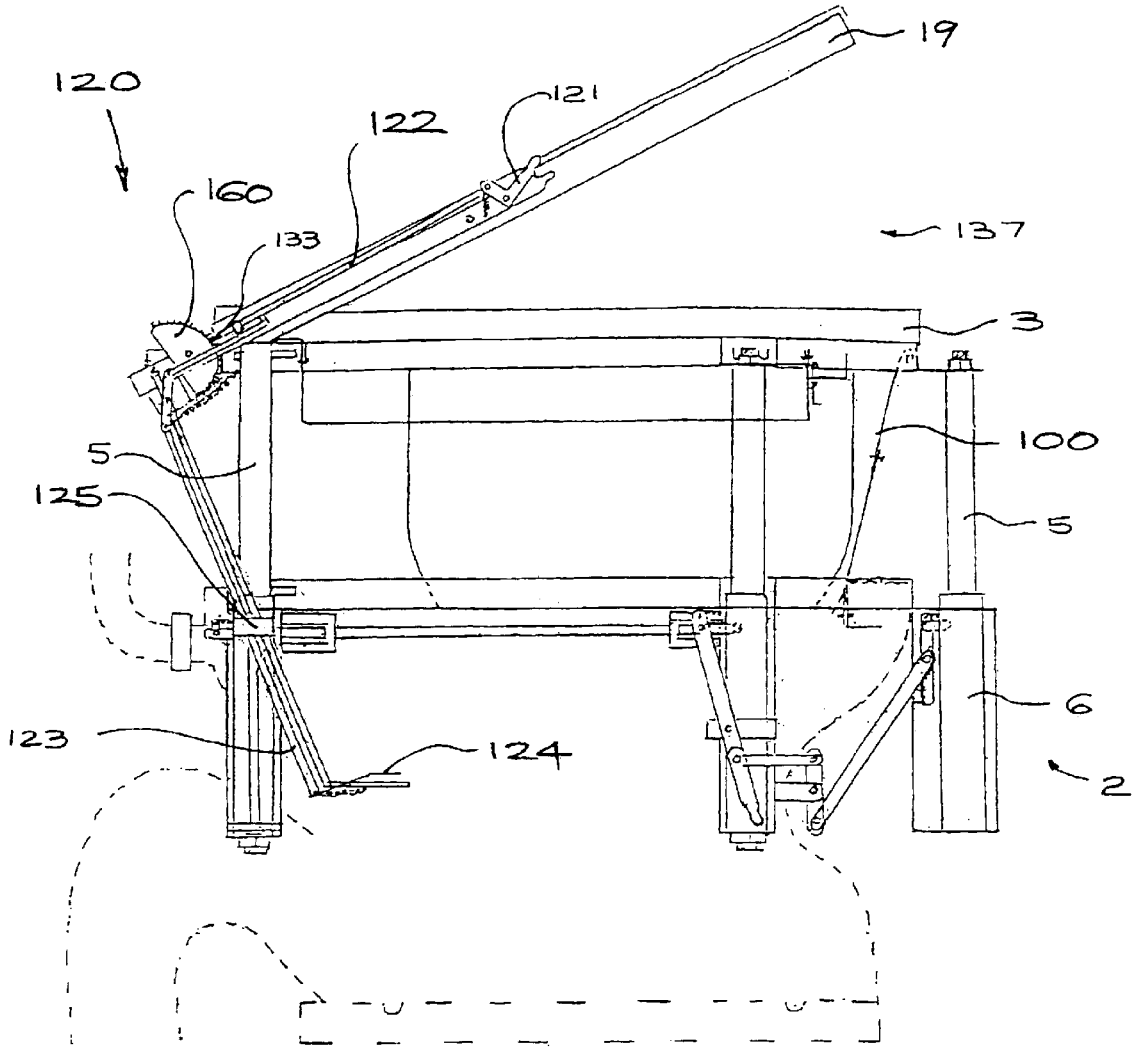
FIG. 24 is a side view of the seat cover lifting mechanism of the seat apparatus of the present invention, with the cover in the open position.
Figure 25A:
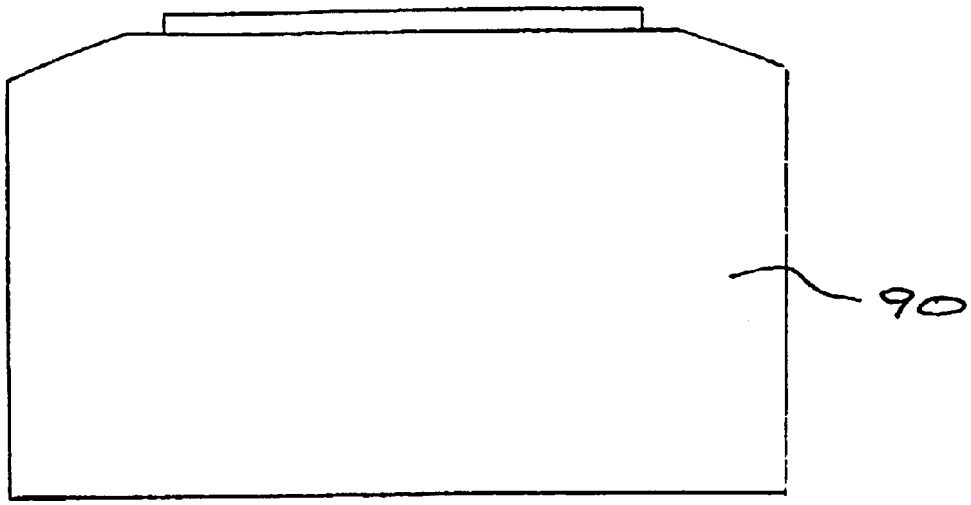
FIGS. 25*a*, 25*b*, 25*c* and 26*a*, 26*b*, 26*c* show two embodiments of an extension portion of the seat apparatus of the present invention.
Figure 25B:
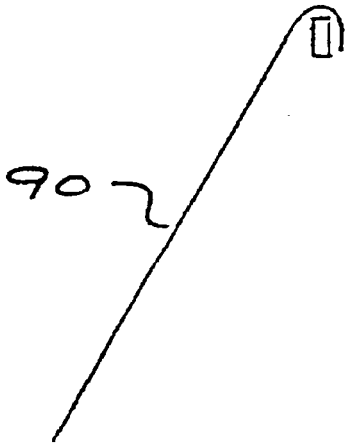
Figure 25C:
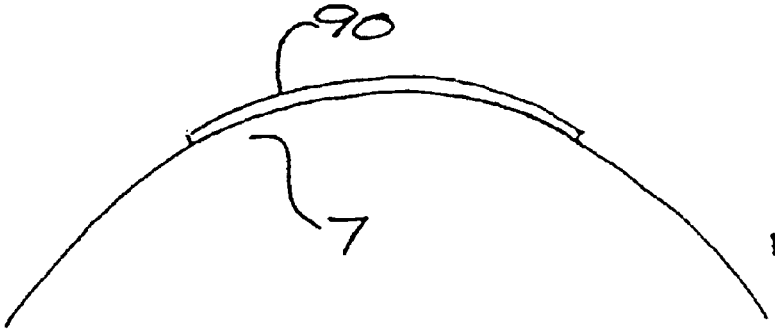
Figure 26A:
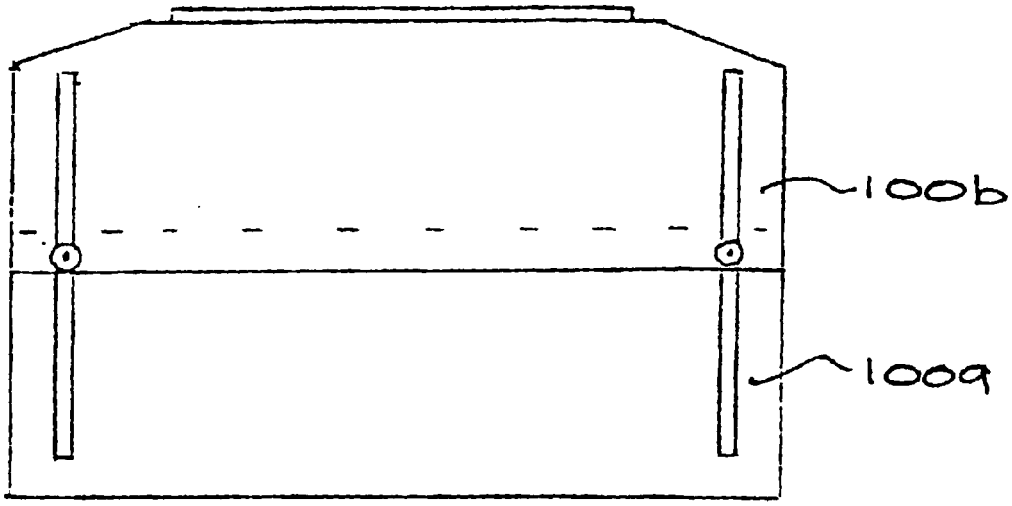
Figure 26B:
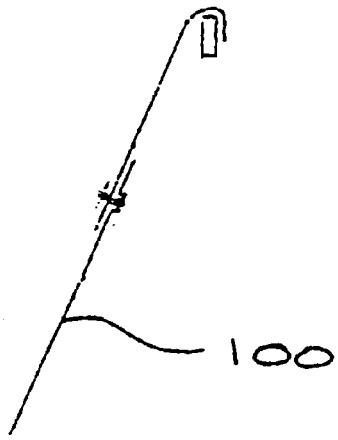
Figure 26C:
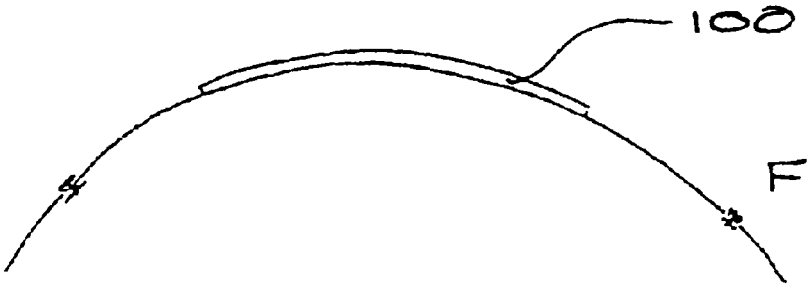

FIGS. 23 and 24 illustrate a preferred embodiment of the invention (with the toilet seat lid 19 in the closed and opened positions respectively). A toilet seat lid opening mechanism 120 for raising and holding the lid 19 includes a segment 160 about the centre 130 of which the lid 19 is hinged for rotation. The seat assembly 137 comprises the toilet seat 3 and the hinged lid 19 supported on the legs 5 that are received in holders 6 fixed to the clamping band 4 clamped to the toilet bowl 7 (shown in dashed outline). Mechanism 120 is operated by a foot lever 161 fixed lo the lid 19 by a pivot 131 offset from the hinge centre 130 and slidably received within a collar 125 fixed for movement parallel to a longitudinal axis of the legs. A spring-loaded catch 133 which rotates relative to the fixed segment 160 is biased to engage with teeth 132 formed in the periphery of the segment 160 to prevent rotation thereof, the catch 133 is releasable by actuation of the handle 121 or peddle 124, and thereafter returns to the locked position for holding the lid 19 in any one of a plurality of rotated attitudes. A mechanical linkage (of known type) includes sliding shaft 161 which is slidably fixed to collar 125. The peddle 124 and handle 121 are connected by the linkage to release the catch 133, the linkage further including a first bar 123 pivotally connected to the peddle 124 and connected to a rocker 134. The first bar 123 extends adjacent to the lever 161 and is received in the collar 125. A second bar 122 with which the catch 133 is engaged, is connected between the rocker 134 and the handle 121. Springs 135 and 136 connected to the peddle 124 and handle 121 respectively bias the catch 133 to engage the teeth 132.

To raise the lid 19, the user presses down on the peddle 124 thereby releasing the catch 133, further downward movement acts on the foot lever 161 thereby rotating the lid 19, and then releasing the peddle 124 holds the lid 19 in position. Subsequently the lid can be closed by actuation of the peddle 124 or handle 121 to release the catch 133.

Figure 27:
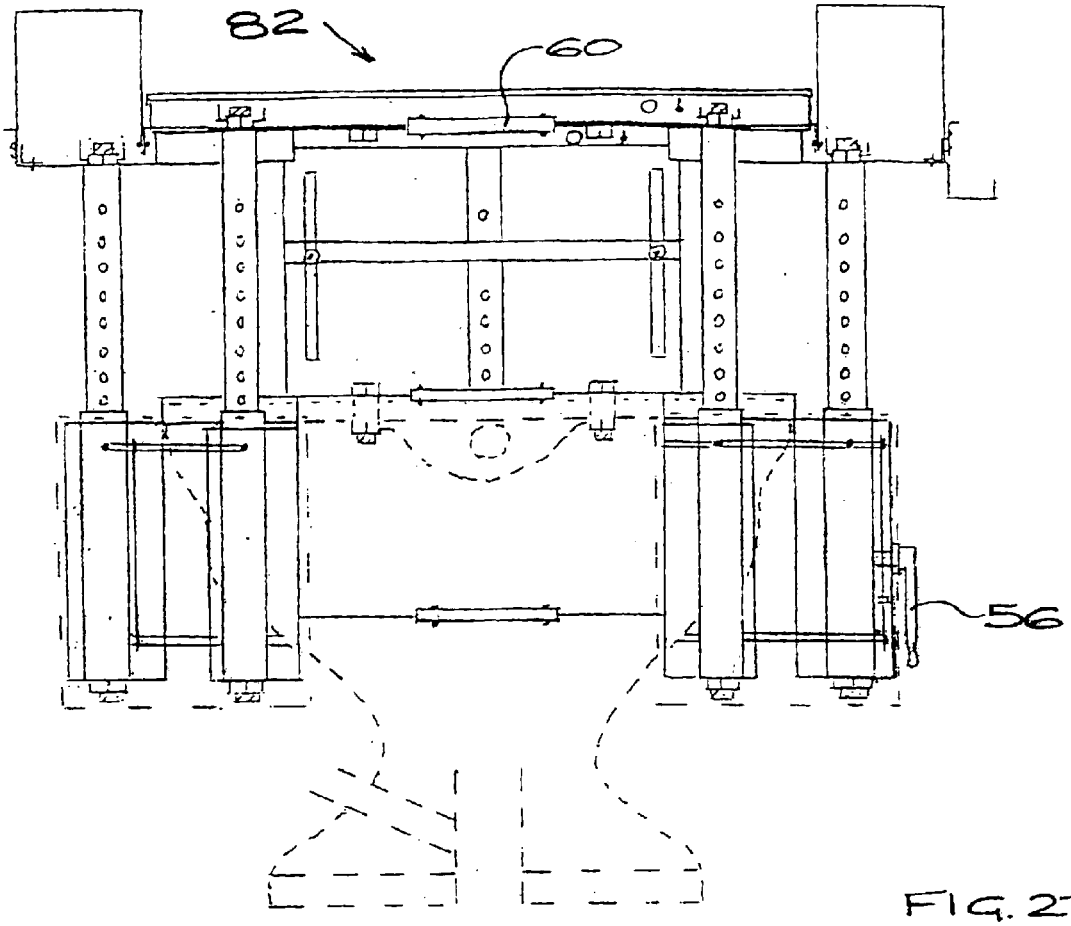
FIG. 27 is a back view of the fifth preferred embodiment of the seat apparatus of the present invention in the same position as in FIG. 1.

FIGS. 25*a*, 25*b*, 25*c*, and 26*a*, 26*b*, 26*c* show two versions of a shield, which can be used in any embodiment of the apparatus (2, 22, 42, 62) in front of the front portion of the insert (16, 36). The shield (90, 100),is shaped to fit about the toilet bowl 7 at the front thereof. FIGS. 26(*a–c*) shows non-adjustable shield 90. FIG. 27 shows an adjustable shield 100 of two portions (100*a* and 100*b*). The two portions are slotted 101 with nuts 102 for adjustability of the overall length of the shield 100.

Figure 28:
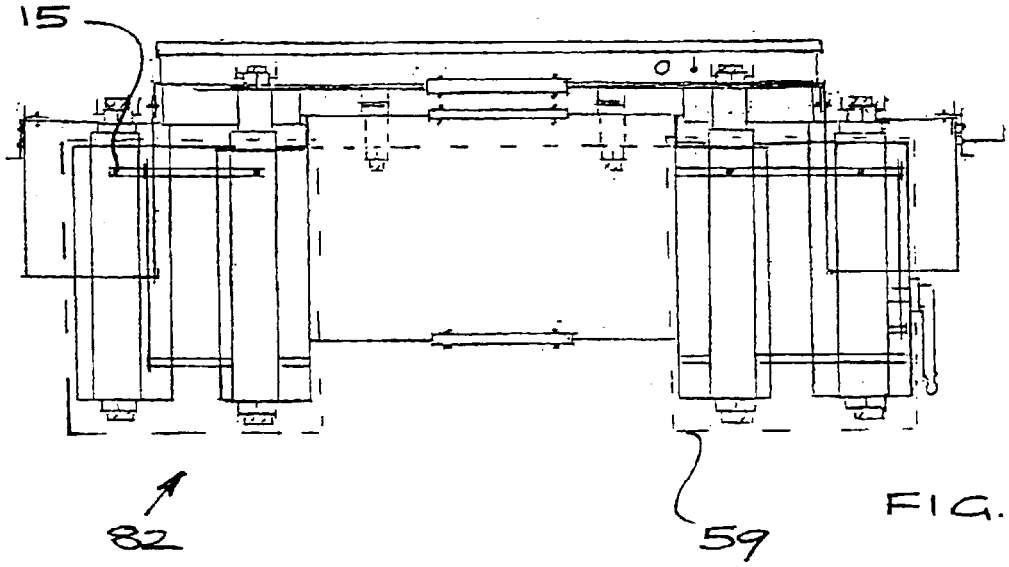
FIG. 28 is a back view of the fifth preferred embodiment of the seat apparatus of the present invention in the same position as in FIG. 2.

FIGS. 27 and 28 disclose a fifth preferred embodiment of the apparatus 82, which incorporates a curved shield 100 without the insert 16. This embodiment also incorporates the skirt 59 and lever 56 for operation of all pins 15 simultaneously, and the adjustability straps 60. Also included is a lever arm 120 for the toilet seat cover) as shown in FIGS. 24 and 25 (*a–c*).

Referring to FIGS. 29 to 32, there is thereshown a first preferred embodiment of a wheeled chair 200 in accordance with the present invention. The wheeled chair 200 incorporates elements of the apparatus (2, 22, 42, 62, 82) in all the embodiments discussed above. Where like numbers are used, like elements are present.

The chair 200 incorporates an insert 16, five legs 5 and holders 6. A hingeable back 66 and two side arms 224 are present. The side arms 224 incorporate rollers 225 but are otherwise hingeable in like manner as the arms 24. The rollers 225 can be used when the arm 224 is in a horizontal position, to assist the passage of someone from a bed (or the like) to the chair 200. The chair 200 incorporates a series of wheels 201 of known type.

The toilet seat lid opening mechanism 120 (as described above with reference to FIGS. 23 and 24) is provided on the chair 200 for raising and lowering the lid 19 provided over the seat 3.

Figure 32:
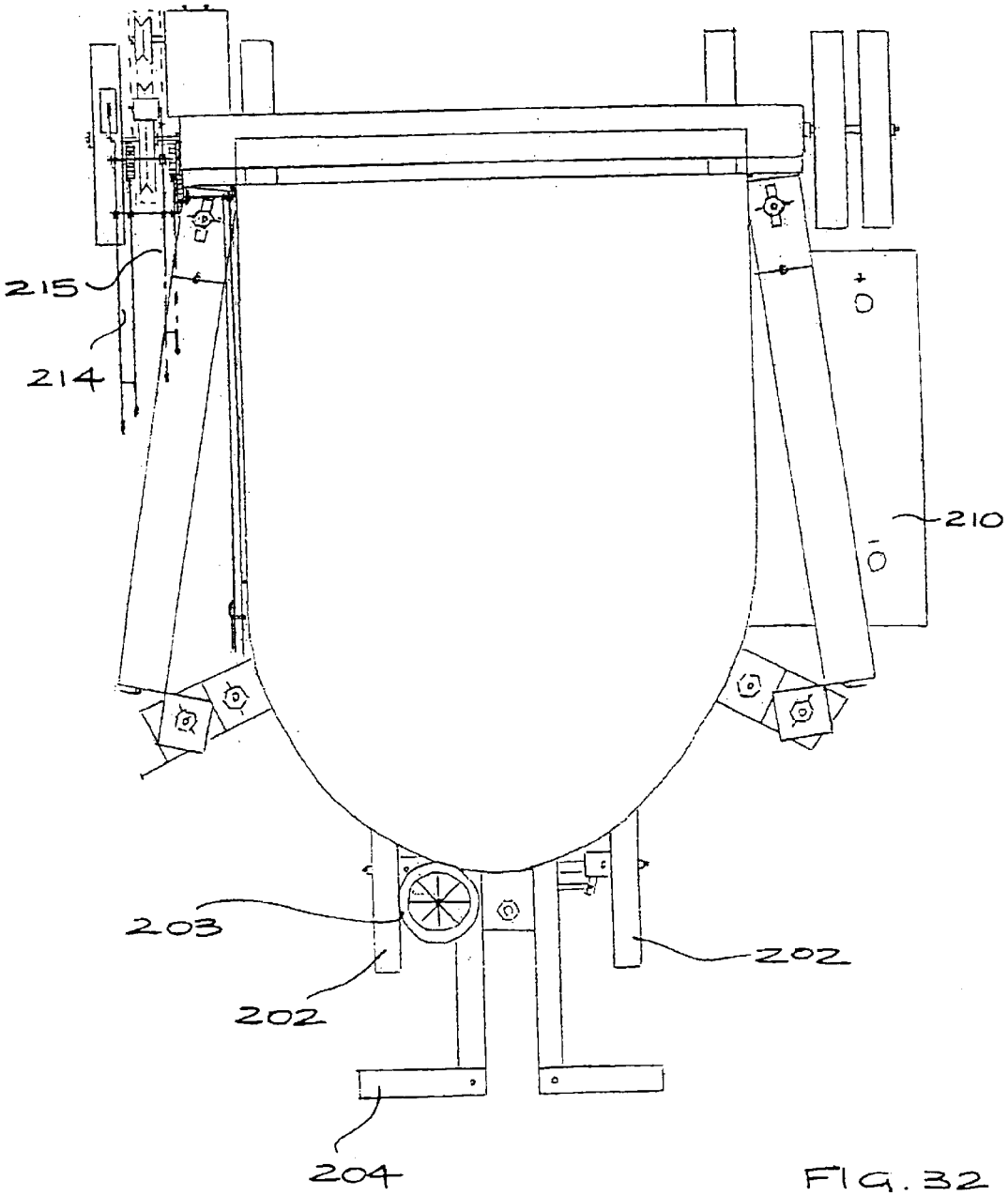
FIG. 32 is a plan view from above of a first preferred embodiment of the wheeled chair of the present invention.

Referring to FIG. 32, the front wheels 202 are steerable by means of a small steering wheel 203 at a height suitable for working by a person sitting in the chair 200. A series of axles 203*a* operable in known manner permit the transfer of rotation of the steering wheel 203 to the wheels 202 to enable steering of the chair. Footrests 204 can be positioned appropriately either side of the front wheels 202 or above the wheels 202 for keeping the feet out of the way of the wheels 202.

A battery 210 provides motor power. This can be an appropriate size for running the engine 211 at the rear of the vehicle 200. A series of pulleys 212 and a bevel gear arrangement 213 (FIG. 31) transfer power from one side of the chair 200 to the other. This arrangement is required so that the chair 200 can be backed over toilet 7. Thus the adjustability of the height of the chair 200 can be used in conjunction with the toilet 7 so that an adjustable toilet seat is provided within the chair 200.

Figure 31:
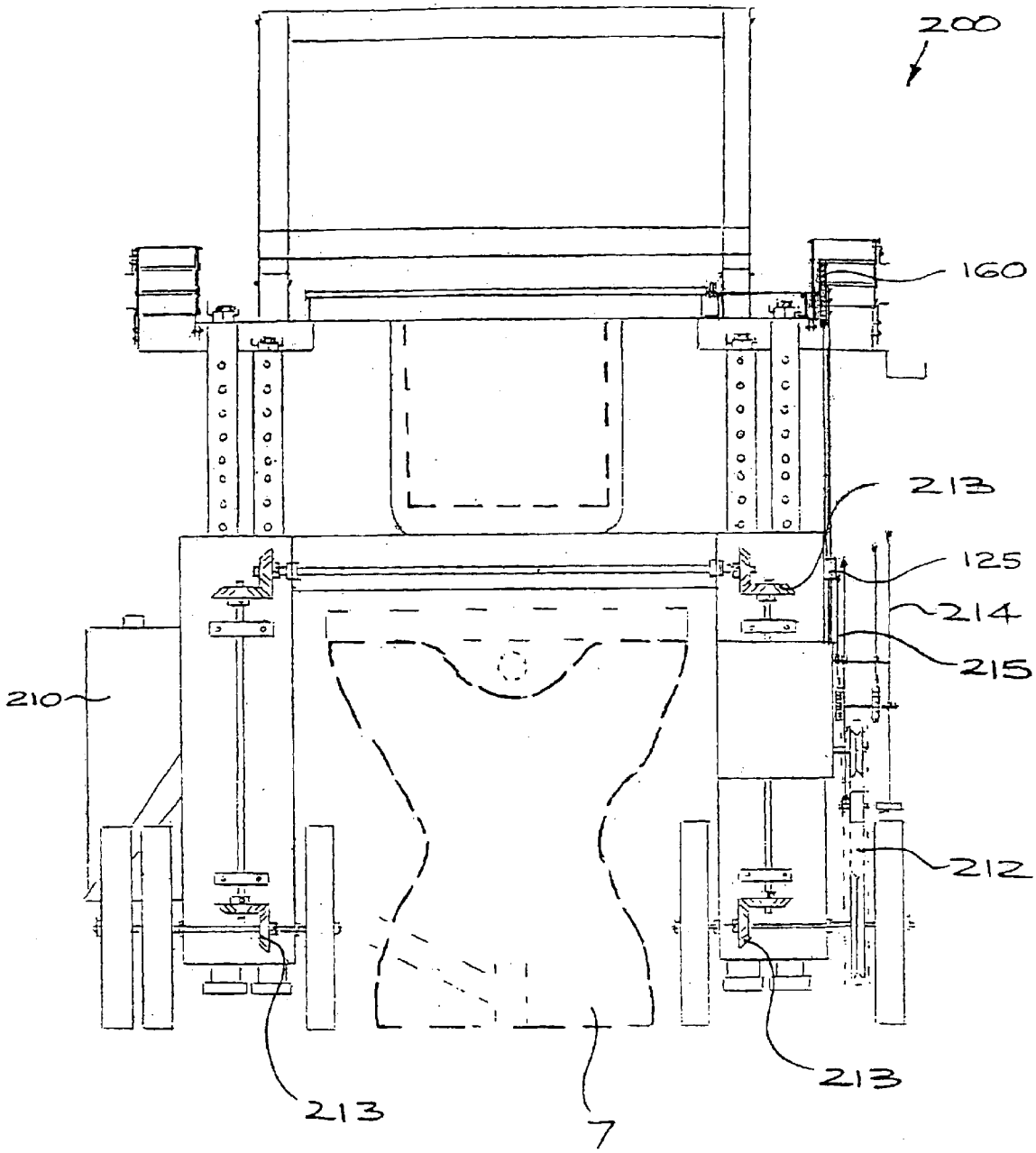
FIG. 31 is a back view of a first preferred embodiment of the wheeled chair of the present invention.

It will be appreciated however that if the portable insert 36 (with base) is used the gear linkage and drive axle from the pulleys 212 to the second side of the chair 200 may be more direct and need not follow the arrangement shown in FIG. 31 for transferring motion in a vertical and horizontal direction, so that the chair clears the toilet 7.

A brake 214 is used with a series of individual levers in known manner to provide a brake for one wheel 201 or all wheels 201, 202 in known manner. The brake 214 can be of the type that bears against a wheel 201 and can be used to stop the chair 200, or to anchor it in a desired position.

Optionally a ratchet clutch of known type may be incorporated into the chair 200. This permits the chair 200 to be stationary, with the motor 212 running; and also permits the wheeling of the chair 200 when the motor 212 is not running. At speed controller 220, is shown, operable in known manner.

Whilst the chair 200 has been shown with steering, clutch, motor power, brakes and footrests, it will be appreciate by those skilled in the art that the chair 200 may have any or all of these features, either separately or in combination, as is desired. The degree to which all these features are present will depend in part on the degree of mobility and dexterity of the user.

Figure 29:
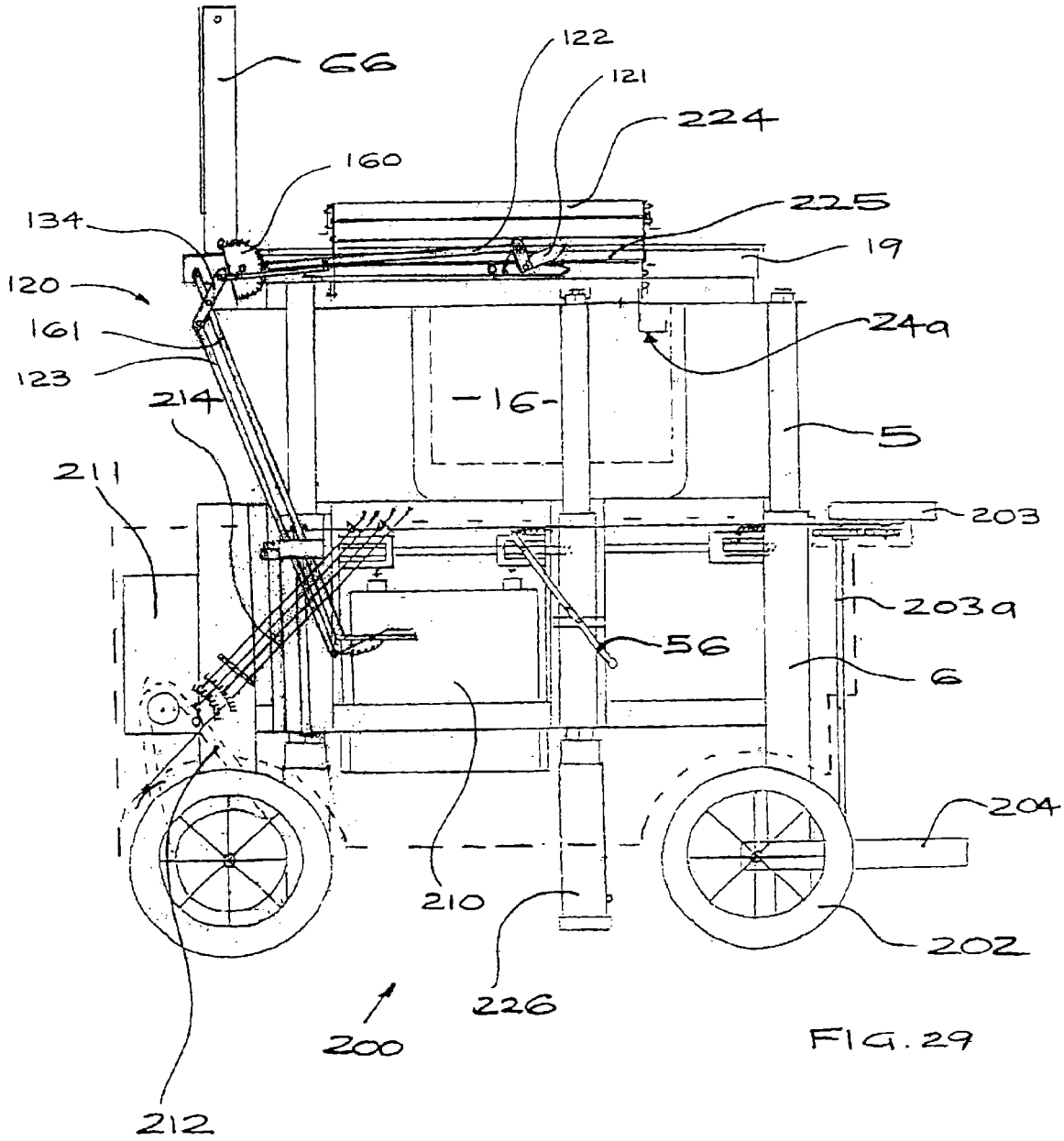
FIG. 29 is a side view of a first preferred embodiment of the wheeled chair of the present invention.
Figure 30:
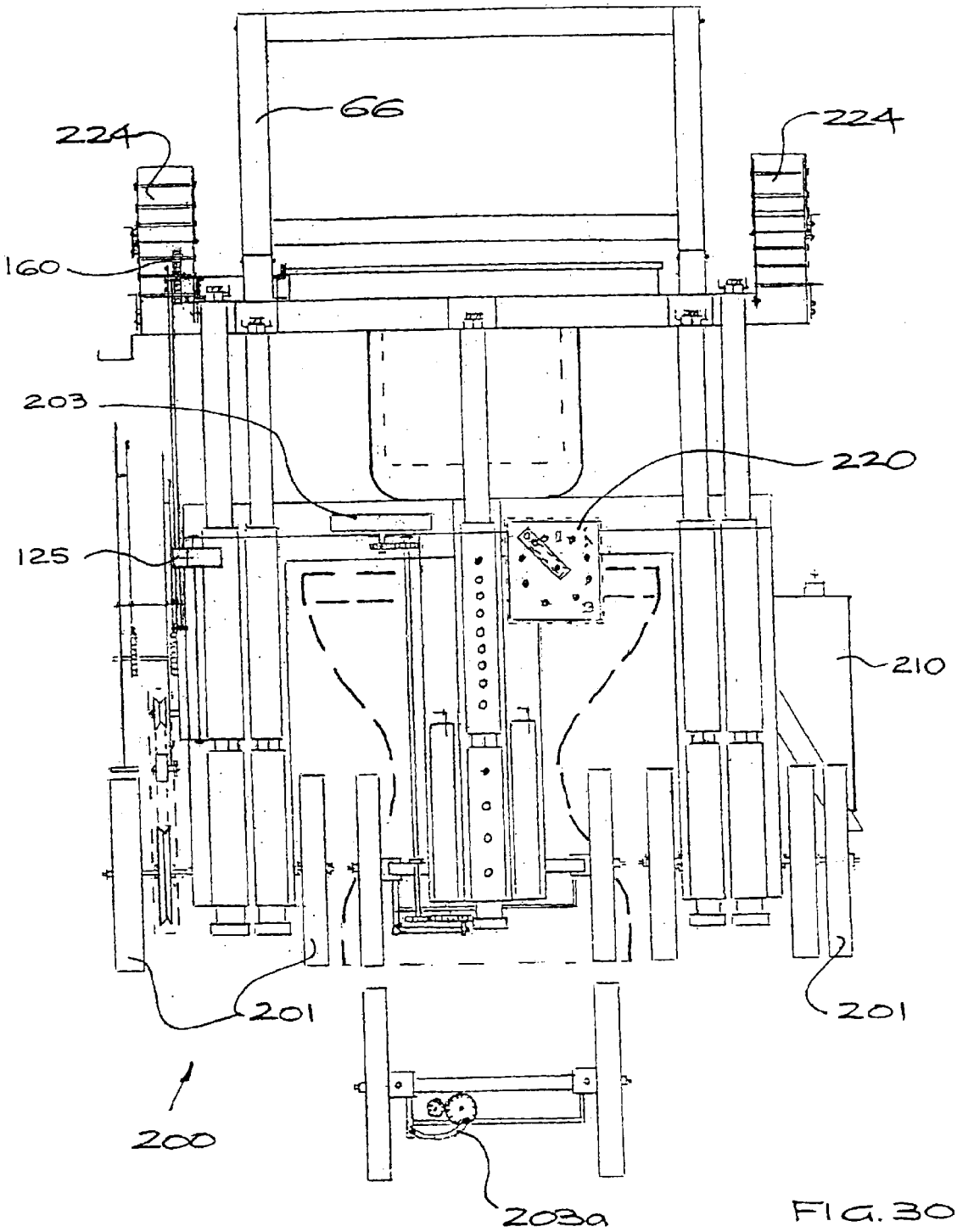
FIG. 30 is a front view of a first preferred embodiment of the wheeled chair of the present invention.

Referring to FIG. 29, an additional set of telescoping inserts 226 may be added to each telescoping leg and insert (5, 6) to raise the chair 200 clear of the wheels(201,202). This permits tile chair 200 to be parked without using the brake 214. Additionally, the chair 200 can be used as a commode, in known manner.

Aspects of the present invention have been described by way of example only and it should be appreciated that modifications and additions may be made thereto without departing from the scope thereof.

What is claimed is:

1. An apparatus for raising and lowering a toilet seat assembly with respect to a toilet bowl, the toilet seat assembly having a hinged lid, the apparatus comprising:

clamping means for releasably securing the apparatus to the toilet bowl;

telescoping legs connected between the clamping means and the toilet seat assembly for allowing the toilet seat assembly to be raised and lowered;

means for fixing the legs to support the toilet seat assembly at two or more heights above the toilet bowl, and a toilet seat lid opening mechanism having a foot lever pivotably connected to the lid for opening thereof, a catch biased to a holding position for holding the lid in one of a plurality rotated attitudes and a foot peddle to release the catch, and wherein the foot lever is slidably received within a collar fixed for movement parallel to a longitudinal axis of the legs.

2. The apparatus of claim 1, wherein said collar is fixed to one of said telescoping legs.

3. The apparatus of claim 1, wherein the toilet seat lid opening mechanism further includes a handle adapted to release the catch.

4. The apparatus of claim 1, wherein the telescoping legs supporting the toilet seat are power actuated.

5. The apparatus of claim 1, wherein the telescoping legs supporting the toilet seat are fluid actuated.

6. The apparatus of claim 1, wherein detents are provided for fixing the legs to support the toilet seat at two or more heights above the toilet bowl.

7. The apparatus of claim 6, wherein each telescoping leg comprises at least one detent and the apparatus further includes means operable to simultaneously engage and disengage each detent.

8. The apparatus of claim 1, further comprising an insert releasably engageable with the seat, the insert being adapted to conform to the internal shape of the bowl.

9. The apparatus of claim 8, wherein the insert incorporates concertina sides.

10. The apparatus as claimed in claim 1, further including a toilet seat heater.

11. The apparatus of claim 10, wherein the toilet seat heater comprises a thermostatically controlled electrical resistance element.

12. The apparatus of claim 1, further comprising at least one of:

at least one arm rest;

at least one collapsible arm rest;

a back rest;

a collapsible back rest;

a protective skirt arranged about the telescoping legs; and a protective skirt arranged about the telescoping legs, the skirt being injection molded from plastic.

13. A wheeled chair including an apparatus for raising and lowering a seat assembly with respect to the wheeled chair, the apparatus being attached to the wheeled chair and the wheeled chair having a plurality of wheels arranged about and under the apparatus, the seat assembly having a hinged lid, the apparatus comprising:

telescoping legs connected between the wheeled chair and the toilet seat assembly for allowing the toilet seat assembly to be raised and lowered;

means for fixing the legs to support the toilet seat at two or more heights above the wheeled chair, and a toilet seat lid opening mechanism having a foot lever pivotably connected to the lid for opening thereof, a catch biased to a holding position for holding the lid in one of a plurality rotated attitudes and a foot peddle to release the catch, and wherein the foot lever is slidably received within a collar fixed for movement parallel to a longitudinal axis of the legs.

14. The wheeled chair of claim 13, wherein the chair further comprises a steering mechanism adapted to turn at least one set of the wheels.

15. The wheeled chair of claim 13, further comprising at least one brake engageable with at least one of the wheels.

16. The wheeled chair of claim 13, further comprising a power source and a motor operable by a user of the wheeled chair.

17. The wheeled chair of claim 13, further comprising a clutch co-operating with the motor so as to enable disengagement of the motor by the user.

18. The wheeled chair of claim 13, further comprising one or two footrests.

* * * * *